US009145705B2

(12) United States Patent
Herman

(10) Patent No.: US 9,145,705 B2
(45) Date of Patent: Sep. 29, 2015

(54) RAILING SYSTEM AND TENSIONED POSTS USED THEREIN

(71) Applicant: Joel Duane Herman, Thurmont, MD (US)

(72) Inventor: Joel Duane Herman, Thurmont, MD (US)

( * ) Notice: Subject to any disclaimer, the term of this patent is extended or adjusted under 35 U.S.C. 154(b) by 17 days.

(21) Appl. No.: 13/804,903

(22) Filed: Mar. 14, 2013

(65) Prior Publication Data

US 2014/0008597 A1 Jan. 9, 2014

Related U.S. Application Data

(60) Provisional application No. 61/668,678, filed on Jul. 6, 2012.

(51) Int. Cl.

| | |
|---|---|
| ***E04H 17/08*** | (2006.01) |
| ***E04F 11/18*** | (2006.01) |
| ***E04H 17/22*** | (2006.01) |

(52) U.S. Cl.

CPC ..... *E04H 17/22* (2013.01); *E04F 11/1804* (2013.01); *E04F 11/1812* (2013.01); *E04F 11/1859* (2013.01); *E04F 2011/1821* (2013.01)

(58) Field of Classification Search

CPC ..... E04H 17/04; E04H 17/06; E04H 17/08; E04H 17/10; E04H 17/12; E04H 17/22; E04H 17/24; E04F 11/1859; E04F 2011/1821

USPC ..... 256/32, 37, 47, DIG. 5

See application file for complete search history.

(56) References Cited

U.S. PATENT DOCUMENTS

| | | | | |
|---|---|---|---|---|
| 10,781 | A | | 4/1854 | Coons |
| 890,468 | A | | 6/1908 | Sutherland |
| 1,517,119 | A | | 5/1921 | Luhring |
| 1,664,321 | A | | 3/1928 | Quist |
| 1,857,435 | A | | 5/1932 | Cole |
| 2,315,516 | A | | 4/1943 | Gray |
| D174,201 | S | | 3/1955 | Tedaldi et al. |
| 3,717,327 | A | * | 2/1973 | Schmidt et al. ..... 256/41 |
| 3,720,401 | A | | 3/1973 | Loch et al. |
| 3,921,960 | A | | 11/1975 | Bright |
| 4,003,553 | A | | 1/1977 | Morris |
| 4,048,776 | A | | 9/1977 | Sato |
| 4,146,212 | A | | 3/1979 | Lermer |
| 4,827,683 | A | | 5/1989 | Poole |
| 4,882,891 | A | | 11/1989 | Sero et al. |

(Continued)

FOREIGN PATENT DOCUMENTS

JP 02-24447 1/1990

OTHER PUBLICATIONS

PCT International Search Report and Written Opinion, PCT/US2013/049223, Sep. 24, 2013.

*Primary Examiner* — Joshua Kennedy

(74) *Attorney, Agent, or Firm* — Leveque IP Law, P.C.

(57) ABSTRACT

One or more posts of a railing system are held securely in place by a hidden tensioning cable that extends through a cavity of the post along a longitudinal axis and is tensioned to securely fasten the post securely to a surface of a structure. Placement of the tensioning cable through the cavity allows cable receivers to be placed at desired spacing in one or more receiver channels of the post, the cable receivers operable to receive cable rails of the railing system. The receiver channels are oriented transverse the longitudinal axis of the post and are each configured to receive a receiver in to which a cable assembly may be placed.

18 Claims, 31 Drawing Sheets

(56) References Cited

U.S. PATENT DOCUMENTS

| | | | | |
|---|---|---|---|---|
| 5,586,423 | A | 12/1996 | Mullen | |
| 5,755,431 | A | 5/1998 | Williams | |
| 5,975,793 | A | 11/1999 | Simmons et al. | |
| 6,053,281 | A | 4/2000 | Murray | |
| 6,135,424 | A * | 10/2000 | Bracke | 256/59 |
| 6,213,452 | B1 | 4/2001 | Pettit et al. | |
| 6,270,057 | B1 | 8/2001 | Highley et al. | |
| 6,336,623 | B1 | 1/2002 | McCarthy | |
| 6,666,625 | B2 | 12/2003 | Thornton | |
| 6,902,151 | B1 | 6/2005 | Nilsson | |
| 7,048,090 | B2 | 5/2006 | Dean et al. | |
| 7,063,186 | B1 | 6/2006 | Granke | |
| 7,198,253 | B2 | 4/2007 | Striebel et al. | |
| 7,306,203 | B2 | 12/2007 | Platt | |
| 7,325,788 | B1 | 2/2008 | Stanek et al. | |
| D567,397 | S | 4/2008 | Terada et al. | |
| 7,497,640 | B2 | 3/2009 | Sharp et al. | |
| 7,530,550 | B2 | 5/2009 | Fattori | |
| 7,568,679 | B2 | 8/2009 | Neusch | |
| 7,802,351 | B2 * | 9/2010 | McGinness et al. | 29/458 |
| 7,802,773 | B2 | 9/2010 | Murphy | |
| 8,117,798 | B2 | 2/2012 | Bergman | |
| 2003/0155566 | A1 | 8/2003 | Sax et al. | |
| 2004/0026679 | A1 | 2/2004 | Terrels et al. | |
| 2005/0207838 | A1 | 9/2005 | Striebel et al. | |
| 2006/0022189 | A1 | 2/2006 | Collins | |
| 2006/0091371 | A1 | 5/2006 | Cox et al. | |
| 2006/0140718 | A1 | 6/2006 | Lamore | |
| 2006/0145131 | A1 | 7/2006 | Purvis | |
| 2006/0151760 | A1 | 7/2006 | Vyvyan-Vivian | |
| 2008/0079308 | A1 | 4/2008 | Kretschmer | |
| 2008/0157046 | A1 | 7/2008 | Murphy | |
| 2008/0222873 | A1 | 9/2008 | Draht et al. | |
| 2008/0272353 | A1 | 11/2008 | Fattori | |
| 2009/0050865 | A1 | 2/2009 | Napier | |
| 2009/0315007 | A1 | 12/2009 | Cox et al. | |
| 2010/0301297 | A1 * | 12/2010 | Chapman | 256/47 |
| 2010/0308293 | A1 | 12/2010 | Larkins et al. | |

* cited by examiner

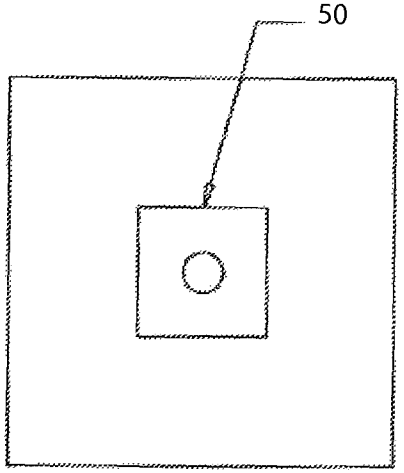
FIG. 8A
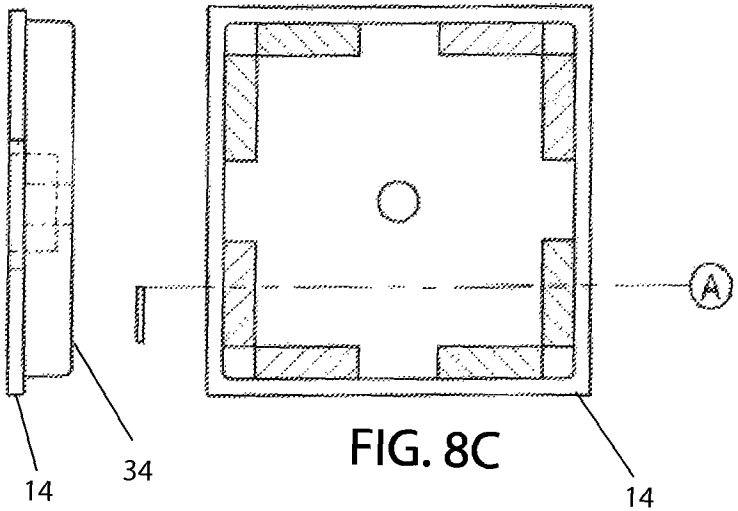
FIG. 8C
FIG. 8B
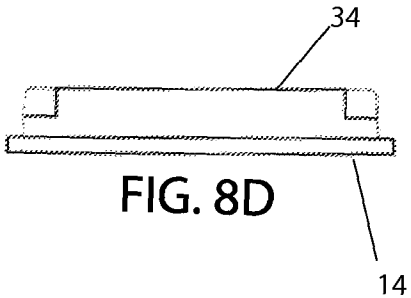
FIG. 8D
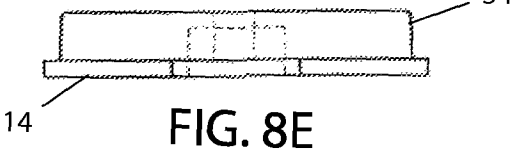
FIG. 8E 10
12
12
12
10
10
52
52
52
10
25
12
12
24
12
25

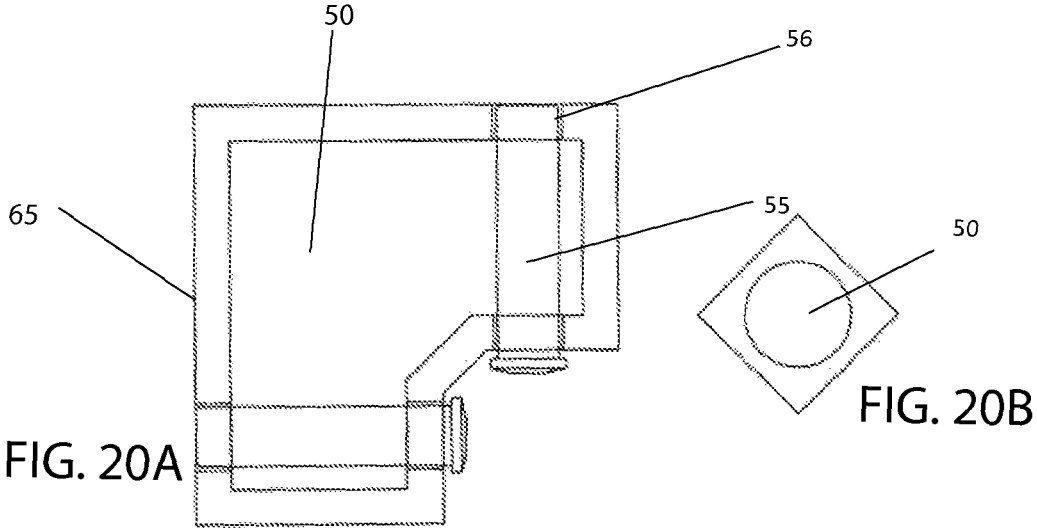
FIG. 20A
FIG. 20B
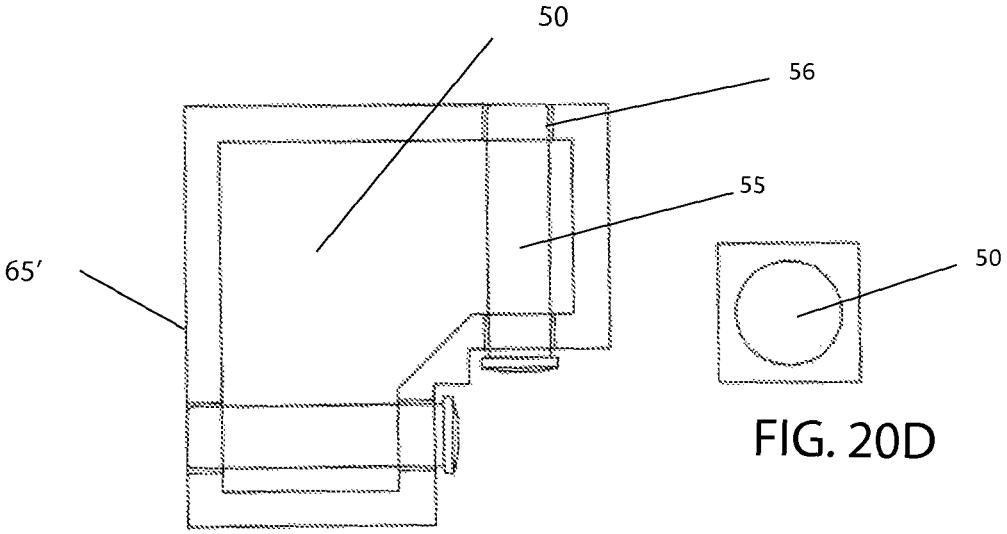
FIG. 20C
FIG. 20D

*FIG. 29* A

FIG. 31A
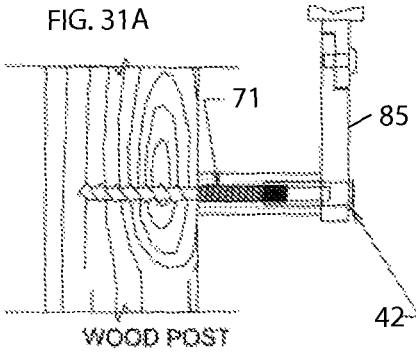
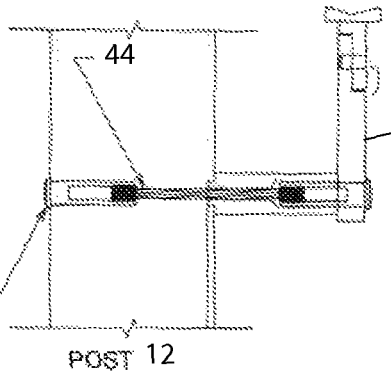
FIG. 31B
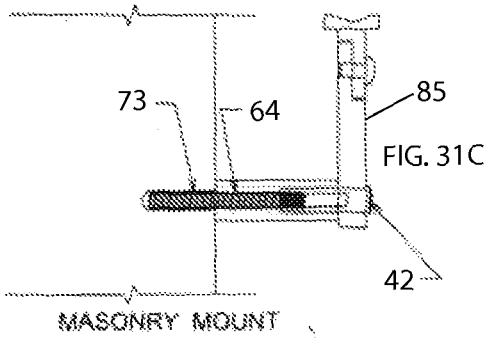
FIG. 31C
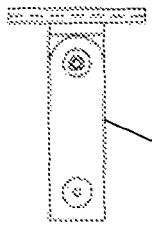
FIG. 31D
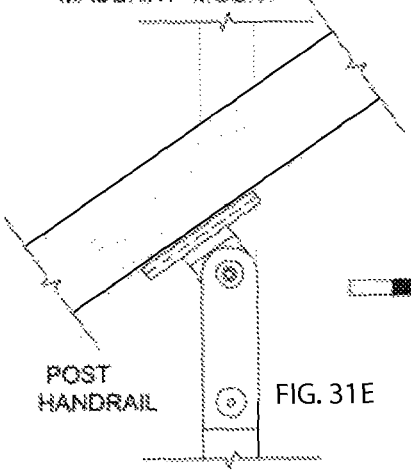
FIG. 31E
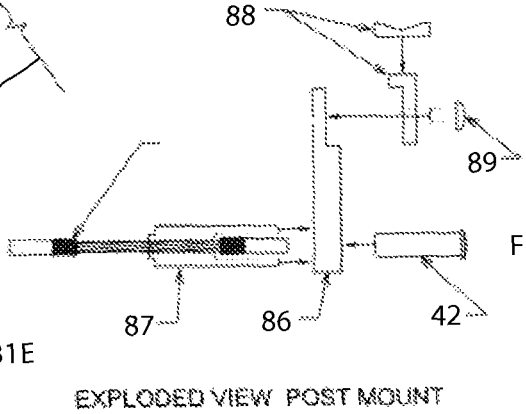
FIG. 31F 100
50

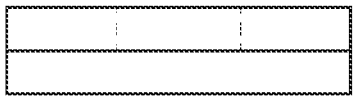
FIG. 35D
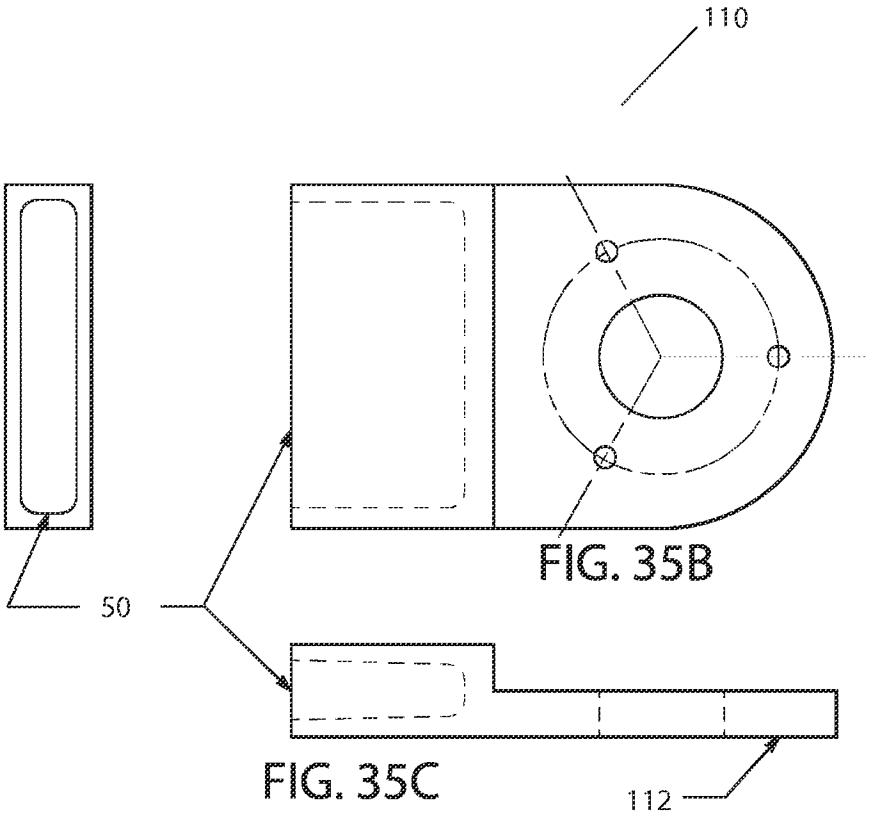
FIG. 35B
FIG. 35C
FIG. 35A

RAILING SYSTEM AND TENSIONED POSTS USED THEREIN

PRIORITY CLAIM

This application claims priority to U.S. Provisional Patent Application No. 61/668,678 filed Jul. 6, 2012, which is hereby incorporated herein by reference.

BACKGROUND

In the railing industry, cable railing systems typically require the use of many components and are labor intensive, requiring a fabricator to install. They additionally are not always aesthetically pleasing as fittings and connections of the railing system, including connections of cable fittings to posts, are often in plain view. Moreover, multiple posts must be currently used at a location where the direction or orientation of the railing is to be changed. Thus, at a corner location on a deck, for example, a section of railing coming from one direction must terminate in a first post at the corner location and another section of railing leaving the corner in another direction must originate from a second post also in the corner location. This is commonly called the two-post corner system in the railing industry.

BRIEF DESCRIPTION OF THE DRAWINGS

Example embodiments of the present disclosure will be described below with reference to the included drawings such that like reference numerals refer to like elements and in which:

FIGS. 8A-8E illustrate a top plate in use with a combination post of FIG. 2, in accordance with embodiments described herein.

FIGS. 20A-20D, 21A-21B-26 illustrate various exemplary configurations of a corner post, in accordance with embodiments described herein.

FIGS. 28-29A-29B illustrate exploded views of exemplary combination post assemblies, in accordance with embodiments described herein.

FIGS. 31A-31F, 32A-32D, 33, 34A-34D, and 35A-35D illustrate various mounting and hardware options for a railing system, in accordance with embodiments described herein.

DETAILED DESCRIPTION

Figure 1E:
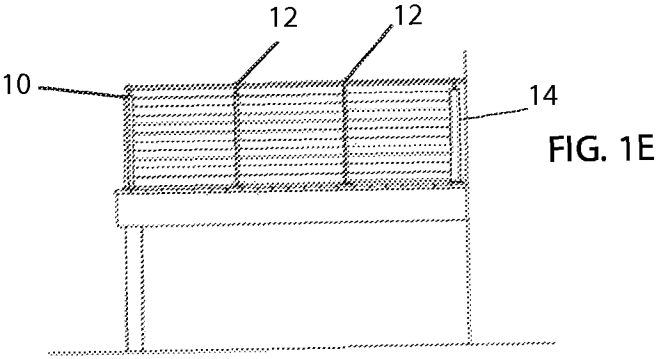
FIGS. 1A-1E is an illustration of an example railing system, in accordance with embodiments described herein.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The invention is not to be considered as limited to the scope of the embodiments described herein.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment", "an example", "an implementation", "an example" or similar terms means that a particular feature, structure, or characteristic described in connection with the embodiment, example or implementation is included in at least one embodiment, example or implementation of the present invention. Thus, the appearances of such phrases or in various places throughout this specification are not necessarily all referring to the same embodiment, example or implementation. Furthermore, the particular features, structures, or characteristics may be combined in any suitable manner in one or more embodiments, examples or implementations without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

One or more posts of a railing system are held securely in place by a hidden tensioning cable that extends through a cavity of the post along a longitudinal axis and is tensioned to securely fasten the post securely to a surface of a structure. Placement of the tensioning cable through the cavity allows cable receivers to be placed at desired spacing in one or more receiver channels of the post, the cable receivers operable to receive cable rails of the railing system. The receiver channels are oriented transverse the longitudinal axis of the post and are each configured to receive a receiver in to which a cable assembly may be placed. The cable assembly may be a cable, a cable rail, a swaged cable assembly, or a swageless cable assembly. The receiver is a tensioning receiver operable to receive, secure and tension a cable assembly placed into the receiver. The receiver channels may be recessed within the post.

One or more posts and an optional top bar of a railing system are held securely in place by a hidden tensioning cable that extends through a cavity along a longitudinal axis of the post and is tensioned to securely fasten the top bar and post securely to a surface of a structure, such as a deck or stairs. The tensioning cable is a cable hidden inside the post that may be a stainless steel cable, such as a threaded stud (such as a s6 stud) on a ready pre-made cable, or a separate all-thread rod. Thus, the term tensioning cable, cable assembly, cable or the like also refers to embodiments that use all-thread rather than a cable. Placement of the tensioning cable through the cavity allows cable receivers to be placed at desired spacing in one or more receiver channels of the post, the cable receivers operable to receive a number of cable rails of the railing system. The receiver channels are oriented transverse the longitudinal axis of the post and are each configured to receive a receiver in to which a cable assembly may be placed. Further, placement of the tensioning cable through the center of the post in the cavity allows for receiver channels to be placed in the body of the post at different orientations perpendicular to one another, as will be shown. This allows a single corner post to support railing oriented in two or more directions with respect to the post, and in any number of desired planes as well. Thus, a corner post as described here allows for two separate runs of railing cable on the same plane in two different directions, all with only one post.

In this manner, the post design shows no exterior screws, bolts, or other fasteners, with everything needed to fasten the rail assembly to a structure hidden inside the post. The tensioning cable holds the entire assembly together with threaded fittings, and the tensioning hardware is hidden inside the post(s), which may be a corner post, intermediate post or a combination post. The post can be surface or side mounted to a deck, flooring, or other surface or stairs. The post can also be installed on wood and man-made material, such as deck material or core drilled into concrete. If core drilled into concrete, this may be accomplished with an embed extension as will be shown.

A wide variety of materials may be used for each of the various components, fixtures, and elements described herein, including aluminum, stainless steel, steel, wood, cast aluminum, brass, bronze, aluminum bronze, nickel aluminum bronze, nick bronze, carbon fiber, and plastic, as well as cast, extruded or extrusion parts.

It is known that for applications on or near the ocean, morning fog carries salty droplets of water called spindrift, which is known to rust even stainless steel over a few short months. Of course, parts of railing systems subjected to direct ocean spray or contact can rust even quicker. While there are cleaners and preserving creams/wax that may be applied to railing material to help combat rusting, this process can be time-consuming and ineffective.

When in contact with spindrift or direct salt water or spray, it is known that bare steel may only last days, painted or power coated steel a matter of months to a year, painted or powder coated aluminum about two to five years, bare aluminum will oxidize and disintegrate into a white powder, and stainless steel will last years but will have rust stains after a few months. Conversely, it is known that bronze, with its unique oxide patina, will hold up well even when in direct contact with salt water, with minimal pitting. Bronze away from spindrift will turn brown and stay that way indefinitely. Bronze subjected to spindrift from the ocean will form a green patina that stops the deterioration of the base metal and will stay green indefinitely.

Thus, while fittings, posts and the tensioning cable assembly may be steel, stainless steel, aluminum, painted or power coated steel, painted or powder coated aluminum in many environments, for salt water environments, these components are preferably made of bronze or some metal having bronze, such as aluminum bronze and nickel aluminum bronze.

Therefore, in accordance with certain aspects of the disclosure there is provided a post assembly with a post having a cavity extending along a longitudinal axis of the post from the top of the post to the bottom of the post and configured to receive a tensioning cable therethrough; and receiver channels oriented transverse the longitudinal axis of the post along one or more sides of the post, each receiver channel configured to receive a receiver into which a cable assembly is placed.

In keeping with other embodiments presented herein, a post assembly has a post having a cavity extending along a longitudinal axis of the post from a top of the post to a bottom of the post and configured to receive a tensioning cable therethrough; receiver channels oriented transverse the longitudinal axis of the post along one or more sides of the post, each receiver channel configured to receive a receiver into which a cable assembly may be placed; a base plate coupled to the bottom of the post and the tensioning cable; a top plate coupled to the top of the post and the tensioning cable; and a tensioner element coupled to the top plate, wherein activation of the tensioner element engages the tensioning cable and tensions the top plate, post, and base plate to a surface to which the base plate is coupled, wherein the tensioning cable is coupled to the base plate and the top plate by a threaded fittings internal to the post and activation of the tensioner element activates the threaded fittings to tension the top plate, post and base plate to the surface to which the base plate is coupled.

In accordance with certain embodiments, a cable railing system for securing a cable railing flush to a surface of a structure: a first post having a cavity extending along a longitudinal axis extending the length of the first post from the top of the first post to the bottom of the first post and configured to receive a first tensioning cable therethrough and a first number receiver channels oriented transverse the longitudinal axis along one or more sides of the first post, each receiver channel of the first number of receiver channels configured to receive a receiver; a first base plate coupled to the bottom of the first post and the first tensioning cable; and a first top plate coupled to the top of the first post and the first tensioning cable; a first tensioner element coupled to the first top plate, wherein activation of the first tensioner element engages the first tensioning cable and tensions the first top plate, the first post, and the first base plate to a surface to which the first base plate is coupled; a second post having a cavity extending along a longitudinal axis extending the length of the second post from the top of the second post to the bottom of the second post and configured to receive a second tensioning cable therethrough and a second group of receiver channels oriented transverse the longitudinal axis along one or more sides of the second post, each receiver channel of the second group of receiver channels configured to receive a receiver; a second base plate coupled to the bottom of the second post and the second tensioning cable; and a second top plate coupled to the top of the second post and the second tensioning cable; a second tensioner element coupled to the second top plate, wherein activation of the second tensioner element engages the second tensioning cable and tensions the second top plate, the second post, and the second base plate to a surface to which the second base plate is coupled; and cable rails operable to be coupled to receivers received by the first group of receiver channels and to receivers received by the second group of receiver channels.

Figure 1D:
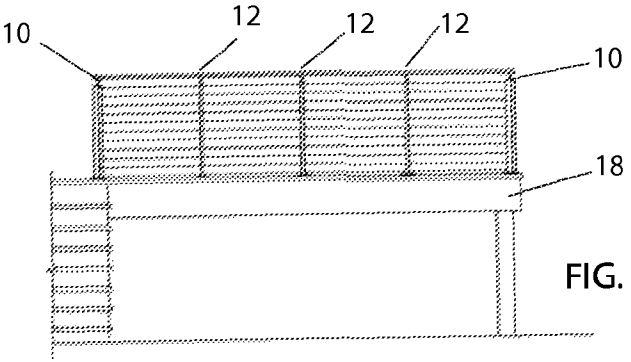
Figure 1C:
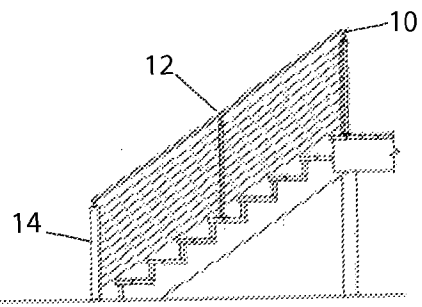
Figure 1A:
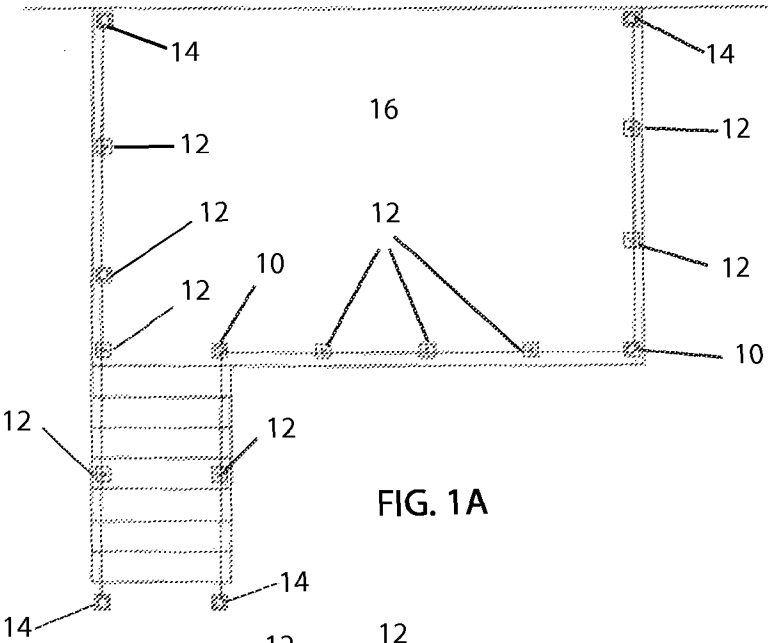
Figure 1B:
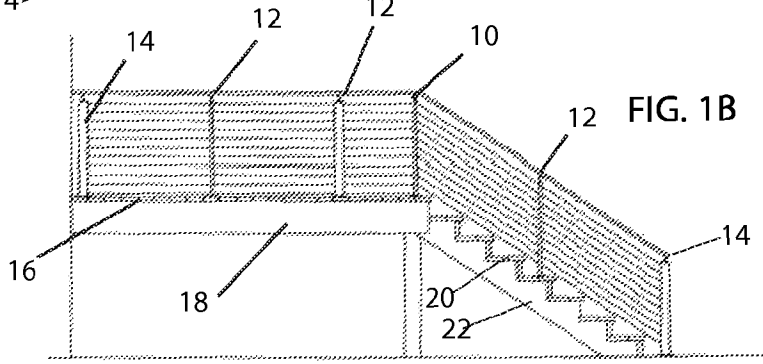

Referring now to FIGS. 1A-1E, an overview of various railing configurations that may use various embodiments described herein is shown. In FIG. 1A, a top view of the surface 16 of a deck 18 with stairs 22 in which railing is used is shown, with views A, B, C and D labeled. In can be seen that the railing is supported by and passes through a number of posts, sixteen in all. Posts 14 are referred to as end, secondary or combination posts, and may serve as a corner post, an intermediate post or as an end post for various hardware and fittings that do not have to be hidden inside the post. Additionally, as shown in the drawings, combination posts may serve as termination points of a particular run of railing. Corner posts 10, of which there are two and may be seen in views B, C and D, support separate runs of railing in different directions, in this example each corner post 10 supports two cable runs 90 degree apart. FIG. 1B, a side view A is shown, in which cable railing can be seen along an edge of the deck 18 and down the set of stairs 22 having a stair surface 20 to which the intermediate post 12 is affixed. In FIG. 1C, side view B of the other side of the stairs 22 is shown, in which end post 14 is affixed to the bottom surface, which may be ground or a patio, for example, an intermediate post 12 between posts 14 and 10 is affixed to a surface 20 of stairs 22, and the top post, a corner post 10, is affixed to the surface 16 of deck 18 as shown. In FIG. 1D, side view C of the railing along an edge of deck surface 16 of deck 18 is shown, with this run of railing between two corner posts 10 through intermediate posts 12. In FIG. 1E, view D illustrates a run of railing between corner post 10, through intermediate posts 12 and terminating at end post 14.

It can be seen from the example railing configurations shown in FIGS. 1A-1E, that the entire assembly is held in place with connection hardware being hidden from view. The post design shows no exterior screws, bolts, or other fasteners, with everything needed to fasten the rail assembly to a structure hidden inside the post. As will be described, a tensioning cable assembly holds the entire assembly together with threaded fittings, and the tensioning hardware is hidden inside the post(s).

Figure 2:
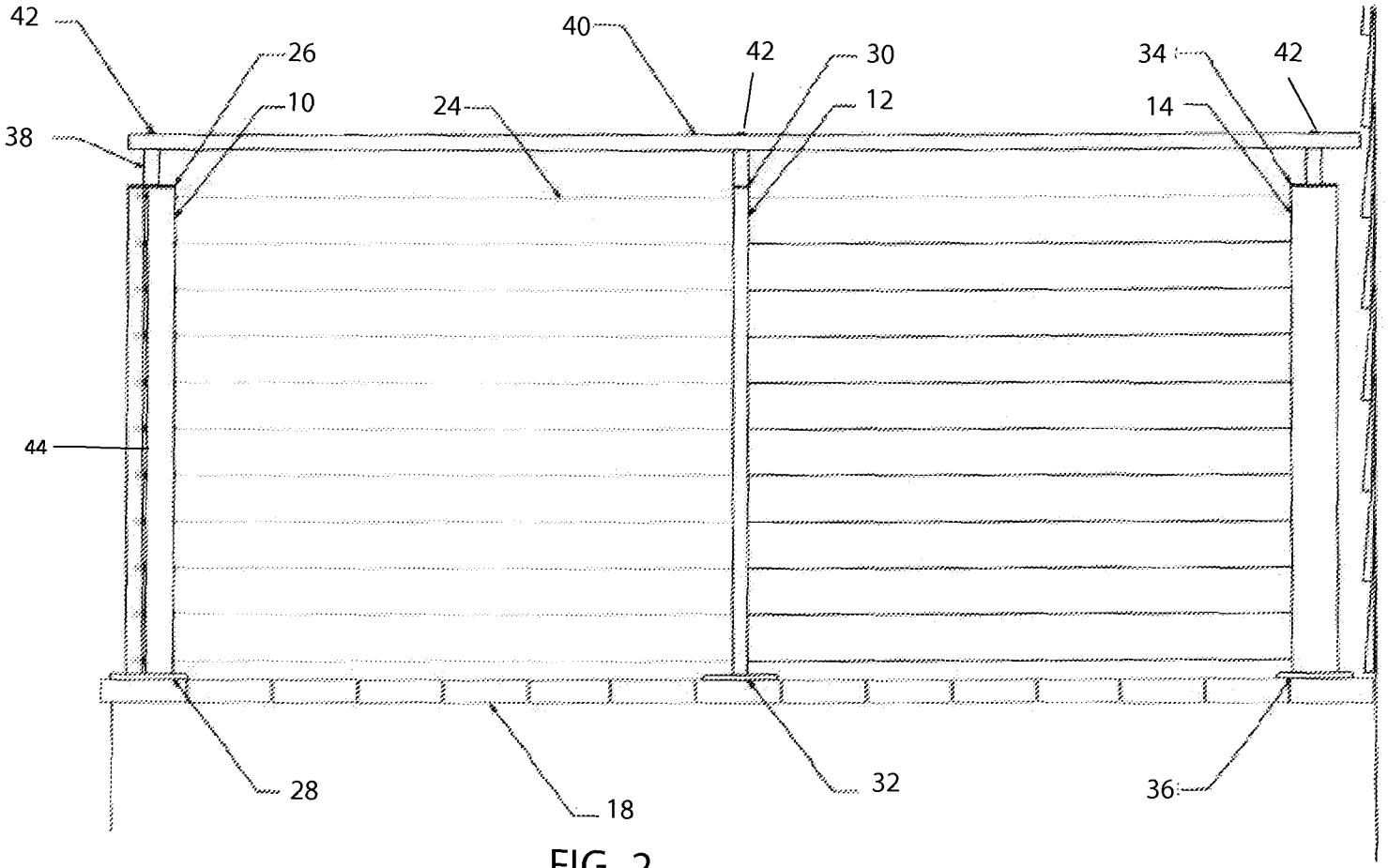
FIG. 2 is another example of a railing system in which three types of posts are illustrated, consistent with certain implementations.

FIG. 2 shows another more detailed example of a rail system with a run of cabling bounded by a combination or end post 14 and corner post 10, with an intermediate post 12, all of which support a number of evenly spaced cable rails 24. Though not shown in this side view, corner post 10 may support a number of other rails that extend in a different direction from that shown for rails 24, such as at right angle or approximately 90 degrees from the direction of run of rails 24. End post 14 is adjacent a structure, such as a house at an edge of deck 18. Each of the posts has an associated base plate and top plate. A standoff 38 on top of the top plates separates the top rail 40 from the posts and a tensioning receiver 42 is used to tension the tensioning cable 44, which may also be referred to herein as a tensioning cable assembly 44, that extends down through a cavity inside corner post 10. Tensioning the tensioning cable 44 with tensioning receiver 42 tensions the entire post assembly from the top rail to the base plate to the surface to which the railing is attached, in this example deck 18. It is noted that while tensioning cable is in most instances hidden inside corner post 10, it is shown here for purposes of illustration. Tensioning cable 44 may likewise be embedded within posts 12 and 14. Again, as noted above, the tensioning cable may alternately be an all-thread rod rather than a cable. If an all-thread rod is sued, it made of stainless steel or bronze, by way of example and not limitation. It is also noted that the terms top rail and top plate may be used interchangeably, with the term top rail generally denoting an expanse going from post to post, while the term top plate may more generally reference a plate located to a particular post.

Referring back to the base plate and top plate associated with each post, reference is now made to FIGS. 3-9. In FIGS. 3A-3C, base plate A 28 and its relationship with corner post 10 is illustrated. The particular shape of corner post 10, shown in the top view of FIG. 3A and the cross-sectional view of FIG. 3C, is one of many different shapes and configurations that may be employed, as will be seen. It can be seen that base plate 28 and corner post 10 which it attached to it, may be core drilled and embedded into concrete as shown in this drawing, as well as in the exemplary concrete embodiment of posts illustrated in FIG. 9. The bolt configuration is illustrated as reference number 49. Setting compound is illustrated as reference number 51 while reference number 53 refers to the post fastening configuration used in this example embodiment. Note that this method of attaching the base plate to a support structure may additionally be used in connection with base plate B 32 and base plate C 36. Three through-holes 43 at the locations shown may be employed, as well as through-holes 45 at each of the five corners of the post as shown. In FIGS. 4A-4E, top plate A 26 and its relationship with corner post 10 is illustrated. The cavity 50 of corner post 10, in which tensioning cable 44 is shown, can be seen in the bottom view of top plate A 26 of FIG. 4A. In the top view of FIG. 4C, tensioning cable 44, which will be tensioned by tensioning receiver 42, is shown. As indicated in the side view of FIG. 4B and the cross-sectional views of FIGS. 4D and 4E, top plate A 26 may be angled or otherwise shaped as needed.

Figure 5A:
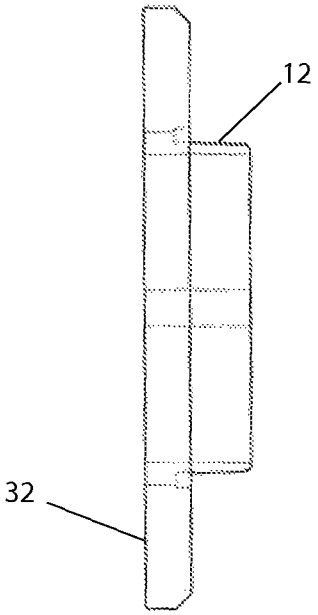
FIGS. 5A-5C illustrate a base plate in use with an intermediate post of FIG. 2, in accordance with embodiments described herein.
Figure 5B:
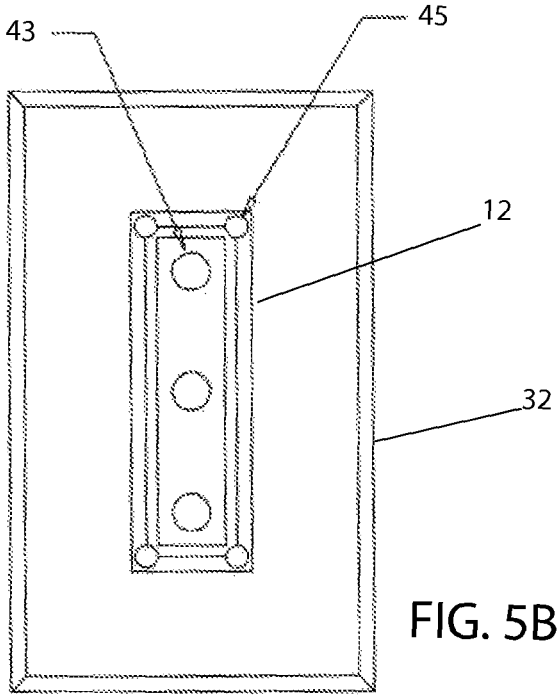
Figure 5C:
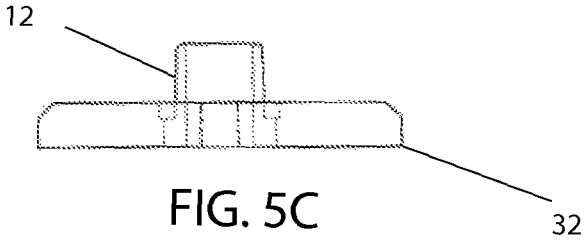
Figure 6A:
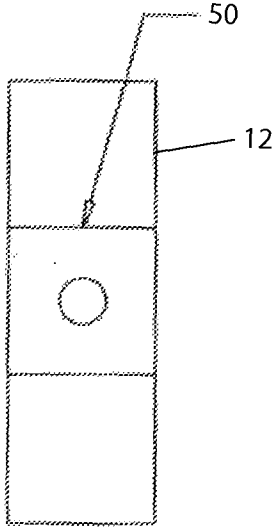
FIGS. 6A-6D illustrate a top plate in use with an intermediate post of FIG. 2, in accordance with embodiments described herein.
Figure 6B:
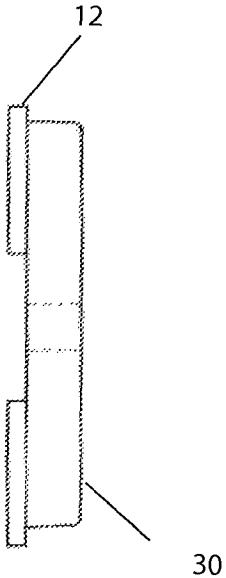
Figure 6C:
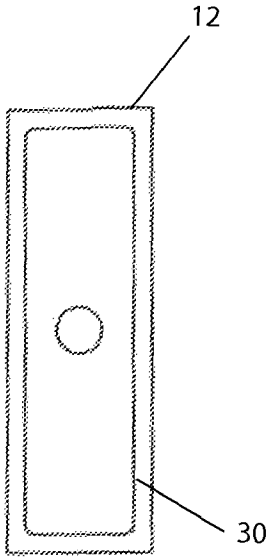
Figure 6D:
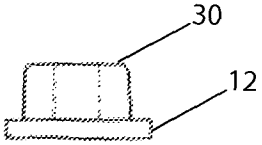
Figure 10A:
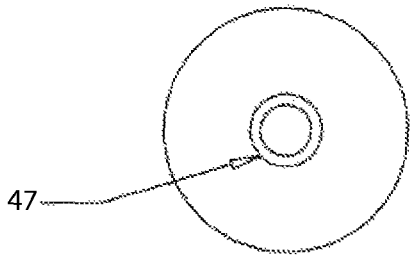
FIGS. 10A-10B illustrate an example embodiment, in accordance with embodiments described herein.
Figure 10B:
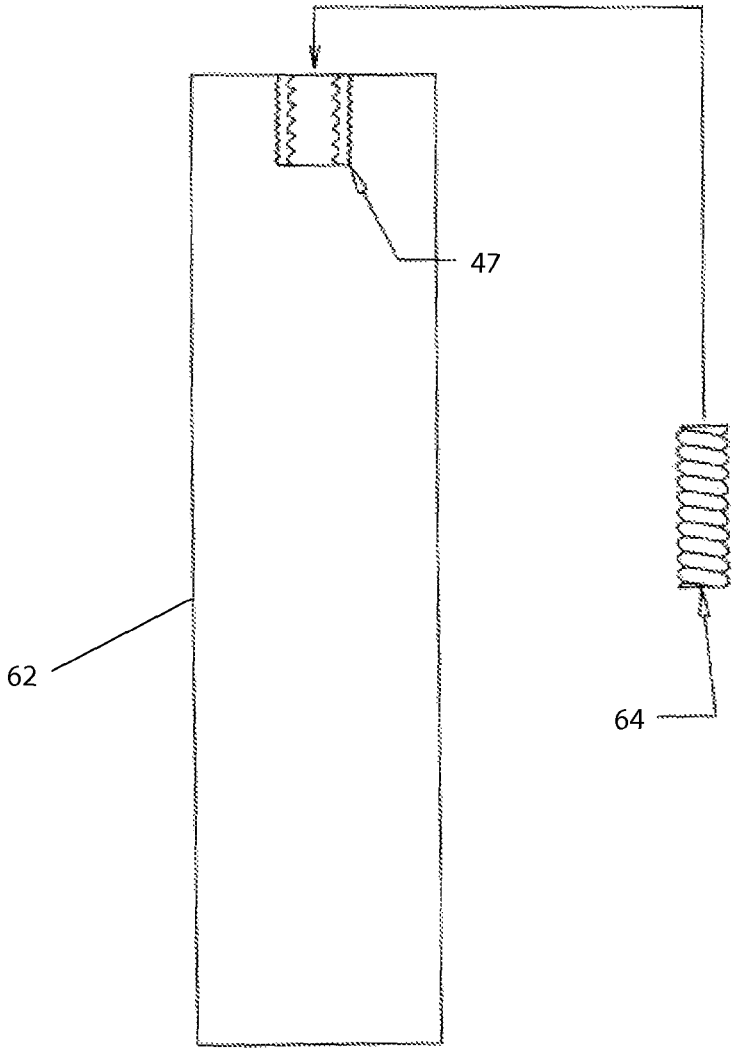

In FIGS. 5A-5C, base plate B 32 and intermediate post 12 are illustrated in which a top view of the combination in FIG. 5B illustrates the through holes 43 in intermediate post 12 to base plate B 32. Also shown are four through-holes located at each corner of the post, in this configuration. Note that as intermediate post 12 does not facilitate multiple runs of railing and simply provides structural support for railing running in one direction, its shape is quite different from that of corner post 10. FIGS. 6A-6D illustrates top plate B 30 and intermediate post 12, with bottom, side and top views of FIG. 6A, FIG. 6B, and FIG. 6C, respectively, illustrating the relation of top plate B 30 to intermediate post 12. FIG. 6B and the cross-sectional view of FIG. 6D illustrate that top plate B 30 may be angled or otherwise shaped as needed. Further, FIGS. 10A-10B illustrate an example embed for installing an intermediate post to a support surface in which a threaded insert 47 is used. In this example, the embed is aluminum but the embodiment is not restricted to an aluminum embed.

Figure 7A:
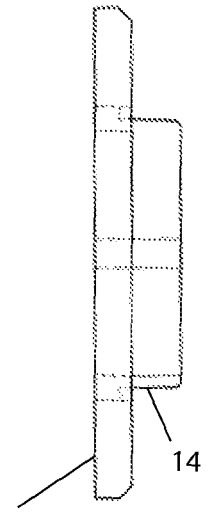
FIGS. 7A-7D illustrate a base plate in use with a combination post of FIG. 2, in accordance with embodiments described herein.
Figure 7B:
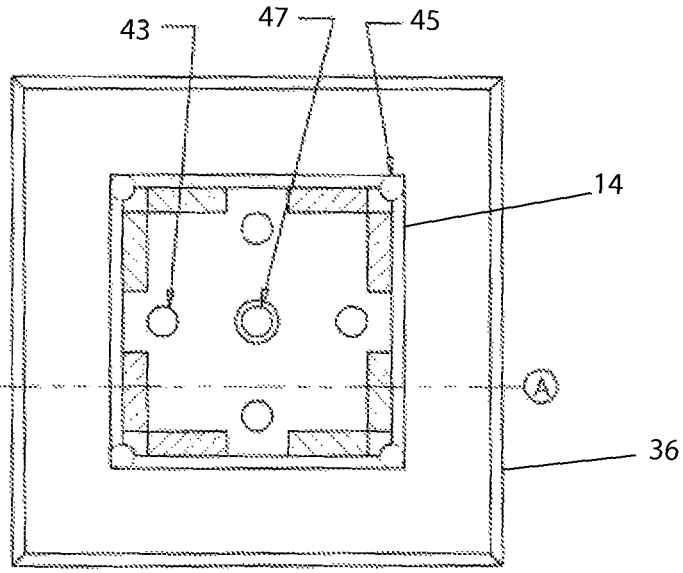
Figure 7C:
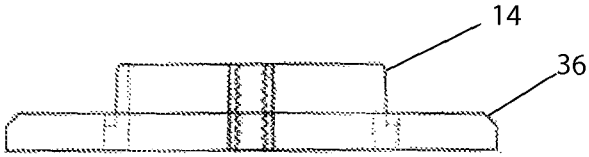
Figure 7D:
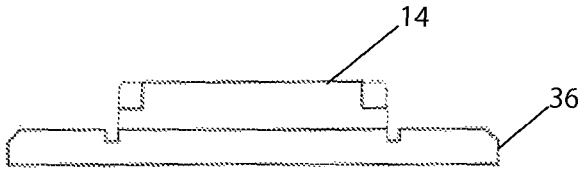
Figure 9:
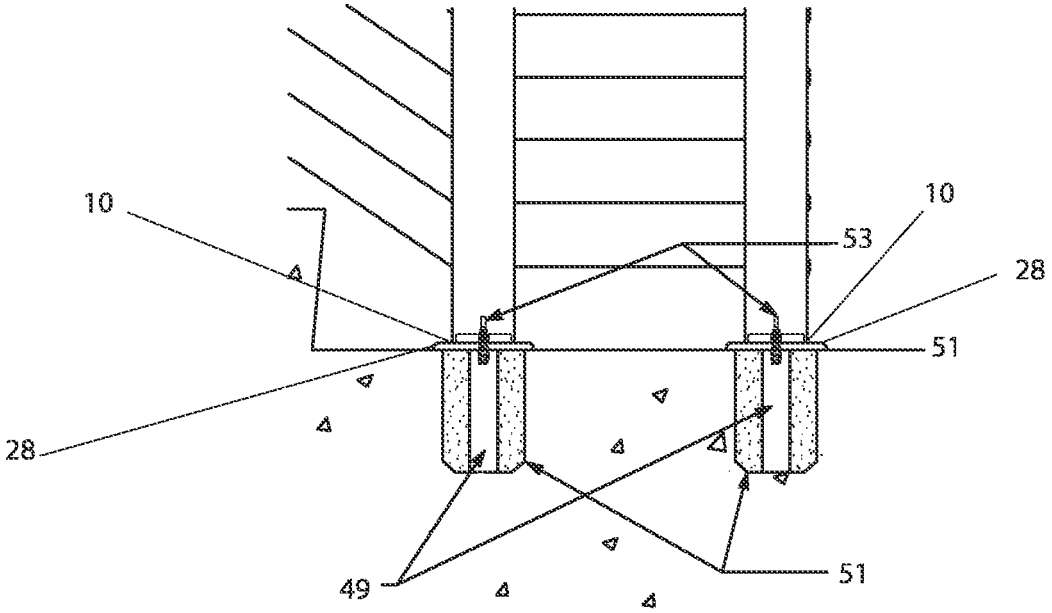
FIG. 9 illustrates an example embodiment of posts, in accordance with embodiments described herein.

In FIGS. 7A-7D base plate C 36 and combination or end post 14 are illustrated, including a cross sectional view at A, in FIG. 7D, side view in FIG. 7A, and cross-sectional view FIG. 7C. It can be seen that the shape of end post 14 reflects its function as a terminating post with four through-hole locations 43, including through-holes at the corners 45, for added strength and stability for the railing system and threaded insert 47. In FIGS. 8A-8E, top plate C 34 and end post 14 are illustrated, with bottom, top and cross section A views of FIG. 8A, FIG. 8C, and FIG. 8D, respectively, shown. Side view 8B is also shown. As indicated, top plate C 34 may be angled or otherwise shaped as needed.

As indicated in the drawings, base plates 28, 32 and 36 and top plates 26, 30, and 34 may be casted and made by a casting process, but this is not required.

Figure 11A:
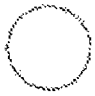
FIGS. 11A-11H illustrate exemplary extrusion profiles, in accordance with embodiments described herein.
Figure 11B:
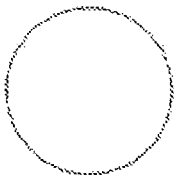
Figure 11C:
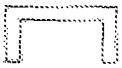
Figure 11D:
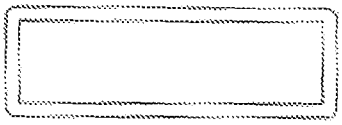
Figure 11E:
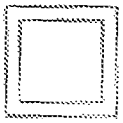
Figure 11F:
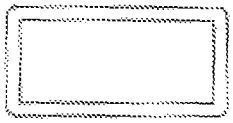
Figure 11G:
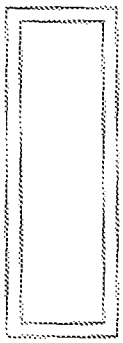
Figure 11H:
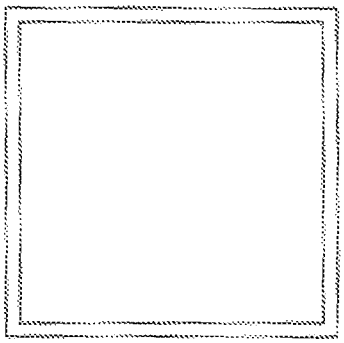
Figure 12A:
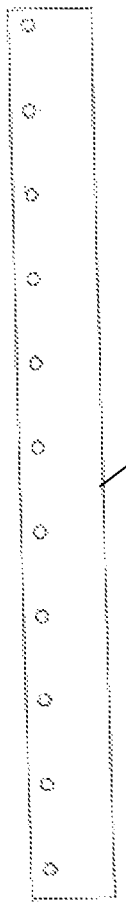
FIGS. 12A-12F and 13A-13B illustrate hole pattern details of posts described herein.
Figure 12C:
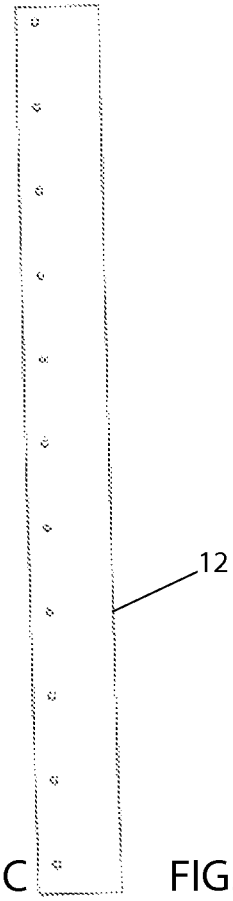
Figure 12E:
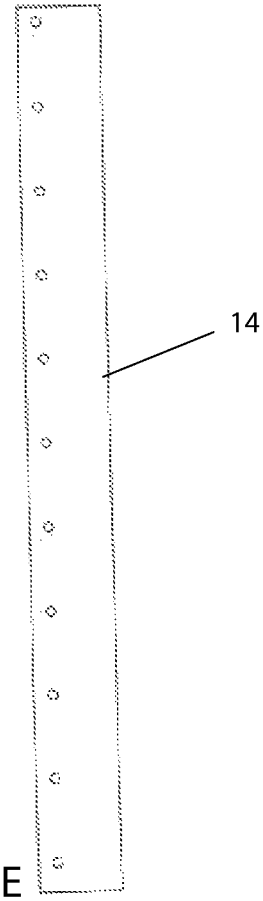
Figure 12B:
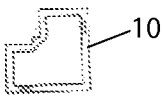
Figure 12D:
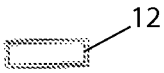
Figure 12F:
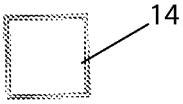
Figure 13A:
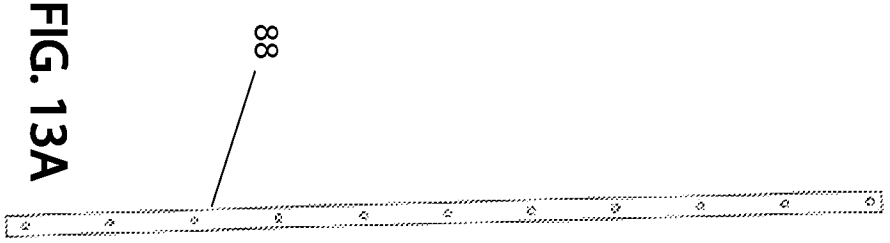
Figure 13B:
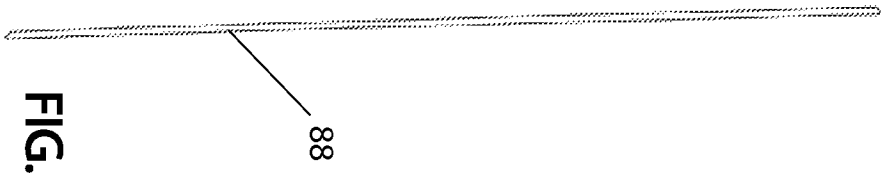
Figure 29:
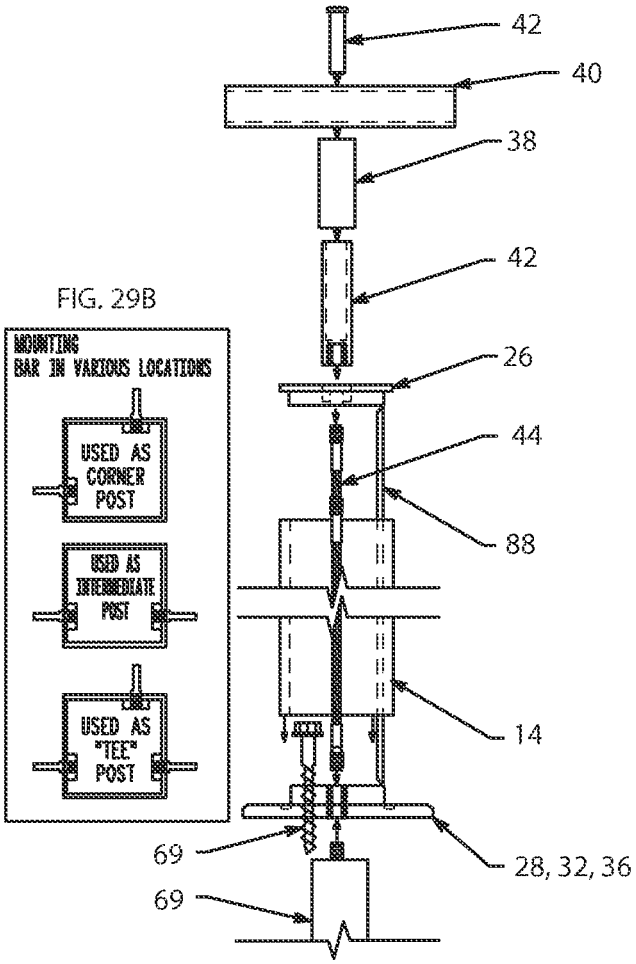

The rails, posts, standoffs that may be employed within the railing systems described may be of varying shapes. FIGS. 11A-11H, 12A-12F, 13A-13B, and 14A-14C illustrate various exemplary extrusion shapes and patterns, and are not meant to be limiting of the elements shown therein. In FIGS. 11A-11H, example shapes of standoffs are shown in FIGS. 11A and 11E, embeds are shown in FIG. 11B, rails are shown in FIGS. 11C, 11D, and 11F, and intermediate and a secondary, combination or end posts are shown in FIGS. 11G (such as for use with the rail of FIG. 11F) and 11H, respectively. The shapes are extrusion profiles in this example. FIGS. 12A-12F and 13A-13B illustrate extrusion hole pattern details for exemplary corner post in FIGS. 12A-B, intermediate post in FIGS. 12C-D, and combination or end or secondary post in FIGS. 12E-F, and bar holes in FIGS. 13A-B. The bar hole pattern detail of FIGS. 13A-B may be used by the flat mounting bar 88 of FIG. 29, for example.

The spacing is similar for all posts, and may be adjusted or change as desired. While a scale of 3 inches=1 foot, 0 inches is shown, such is meant for illustration purposes only and should not be considered limiting.

Figure 14A:
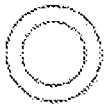
FIGS. 14A-14C illustrate rail standoffs, in accordance with embodiments described herein.
Figure 14B:
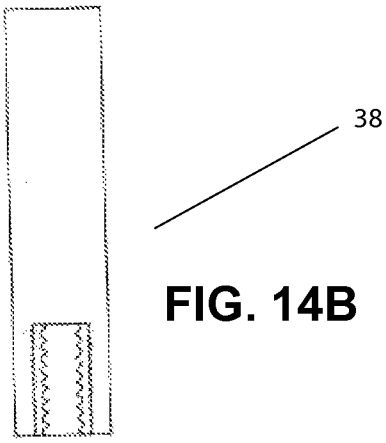
Figure 14C:
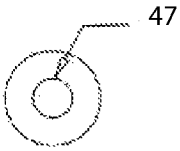
Figure 15:
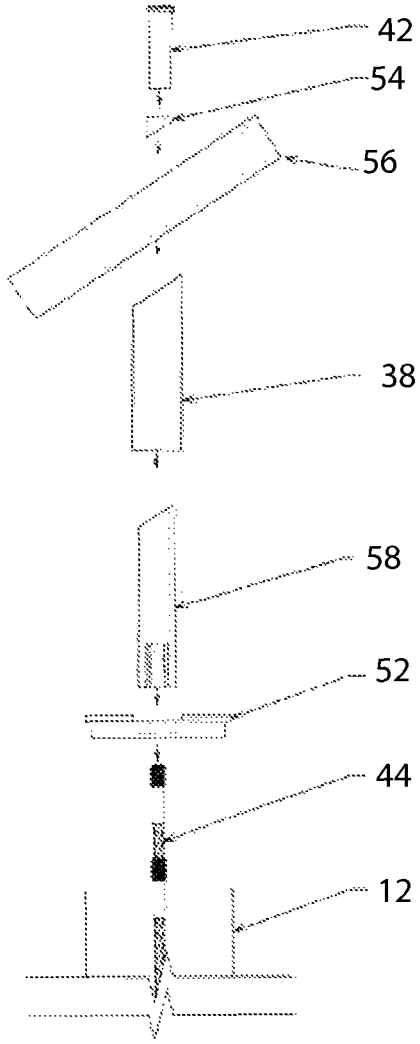
FIG. 15 illustrates a guardrail mounting on stair assembly, in accordance with embodiments described herein.
Figures 16A, 16B:
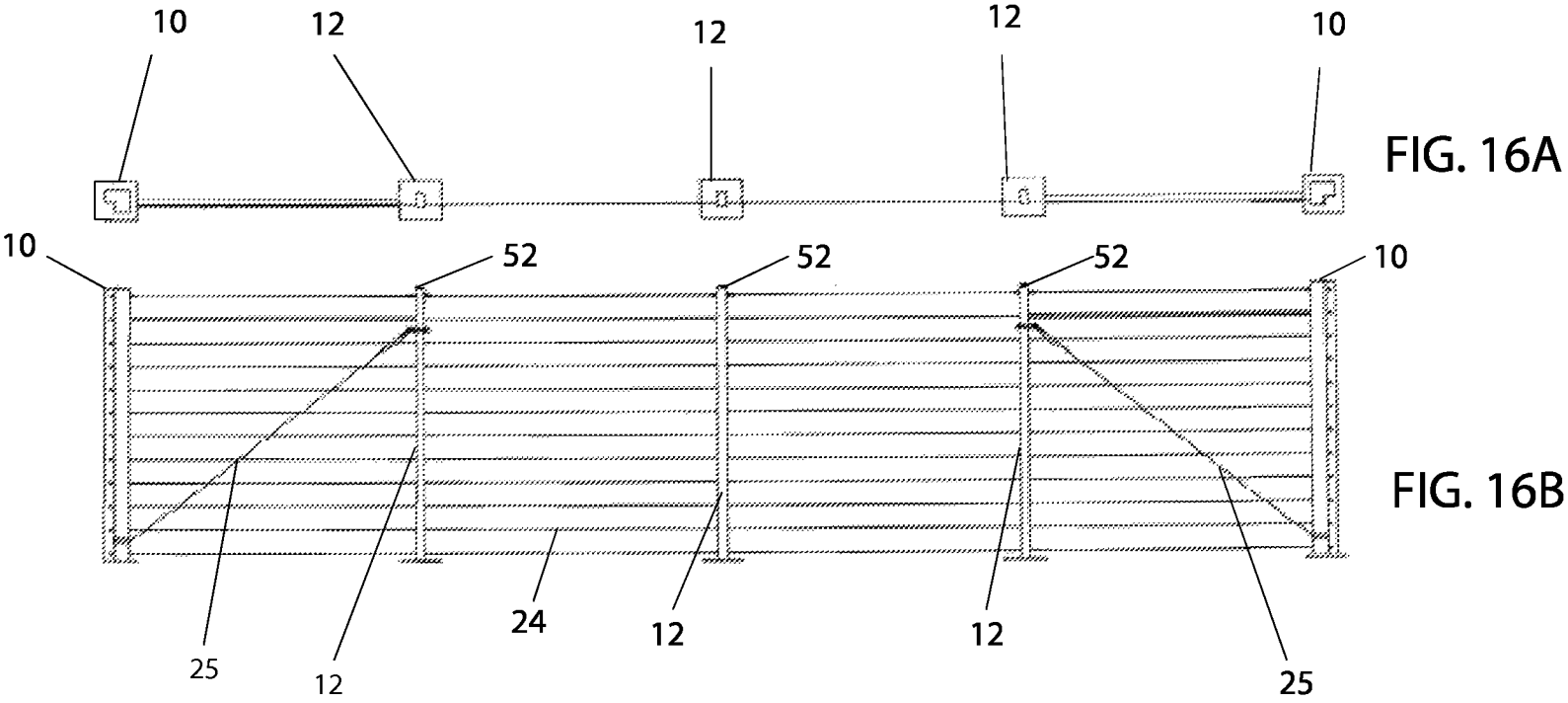
FIGS. 16A-16B and 17A-17B illustrate a railing system without a top rail, in accordance with embodiments described herein.

FIGS. 14A-14C illustrate an example rail standoff 38 with threads 47 shown. As indicated in the system drawing, the rail standoff in is communication with tensioning receiver 42 in order that the tensioning cable can be activated to tighten the entire post assembly to the surface. As will be illustrated later, the standoff for a stair may be a little longer, such as ¼ inch longer or as needed, to allow for steep, angled stairs. When standoffs are being used on a stair, the tensioning receiver still needs to stay in the vertical position. So, a beveled washer may be used to keep the receiver at the correct position and such washers can be used throughout the railing system to keep things symmetrical, or a hole, such as ¾inch hole, may be drilled into the top of the top bar to allow an angled insert to be used. The use of a beveled washer or grommet 54 in a railing for a stair assembly is illustrated in the exploded view of a guardrail mounting of FIG. 15. The angle of railing 56, including cable railing associated with stairs, will vary as needed. The angle cut of the post stair tensioner 58 may be marked after tensioning to match the angle of the stair railing 56.

Figures 17A, 17B:
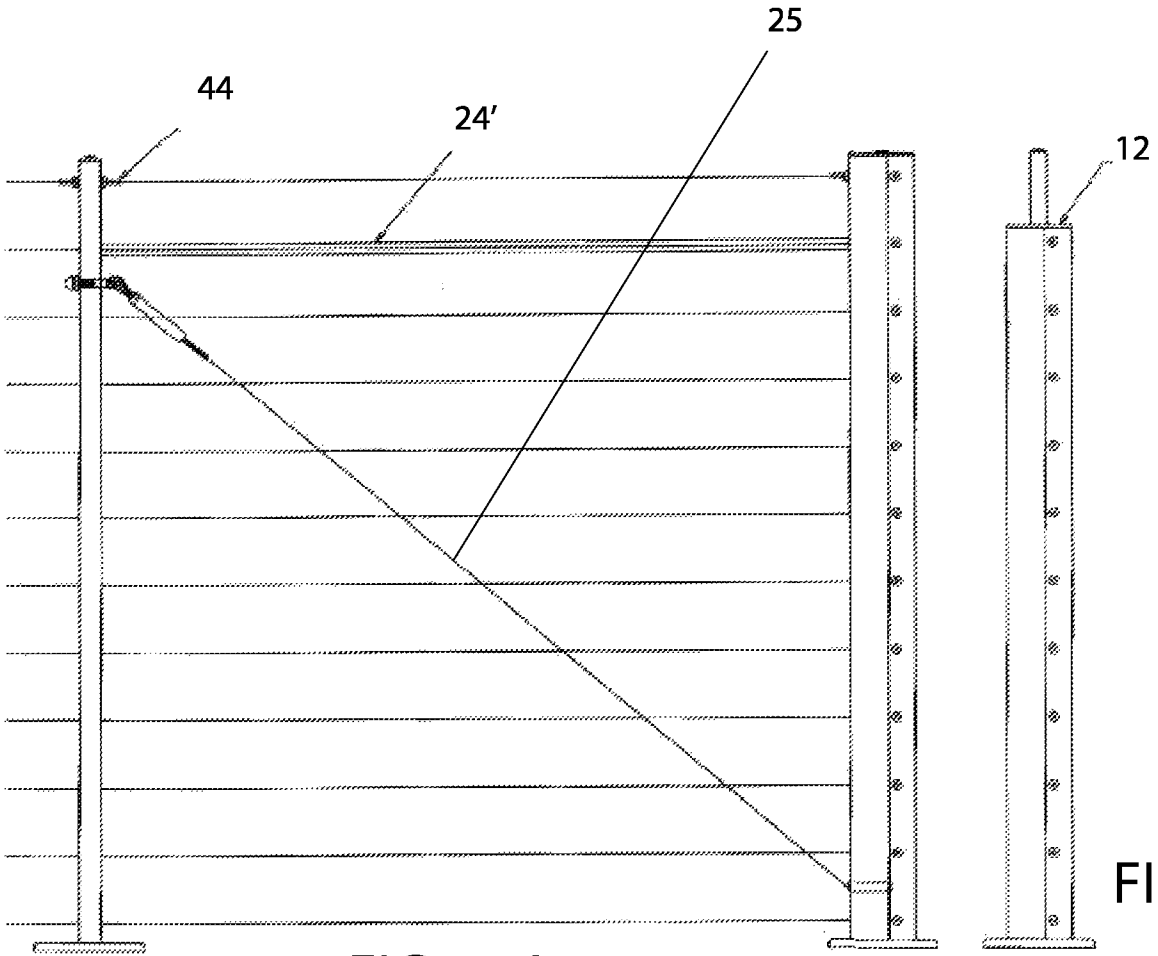

Referring now to FIGS. 16A-16B and 17A-17B, an embodiment in which a top rail 40 is not used is illustrated. In this example railing system, rails 24 are supported by two corner posts 10 between which are fashioned three intermediate posts 12. Also, a support rail, such as a reinforced cable railing 25, may be used to provide structural support, particularly useful when no top bar is sued, only top caps 52 at the top of each post, as shown. In the exemplary drawing, the support rail is attached between the corner post and an adjacent intermediate post, towards the top of the corner post and towards the bottom of the intermediate post, though the places of attachment and diagonal angle employed may be varied, as may the placement of support rail 25 to extend across multiple sections of railing if more support is desired or to achieve a desired aesthetic. Such an arrangement without the top bar permits a cleaner, unhindered view and may be more aesthetically pleasing in certain settings. Additionally, as illustrated in FIG. 17A, a structurally reinforced rail 24' may be optionally used to provide further rigidity and support. In a specific example, not meant to be limiting, the railing may be reinforced with a tube over a cable, such as ½ inch×1 inch by 093 aluminum tubing over the cable.

Figures 18A, 18B:
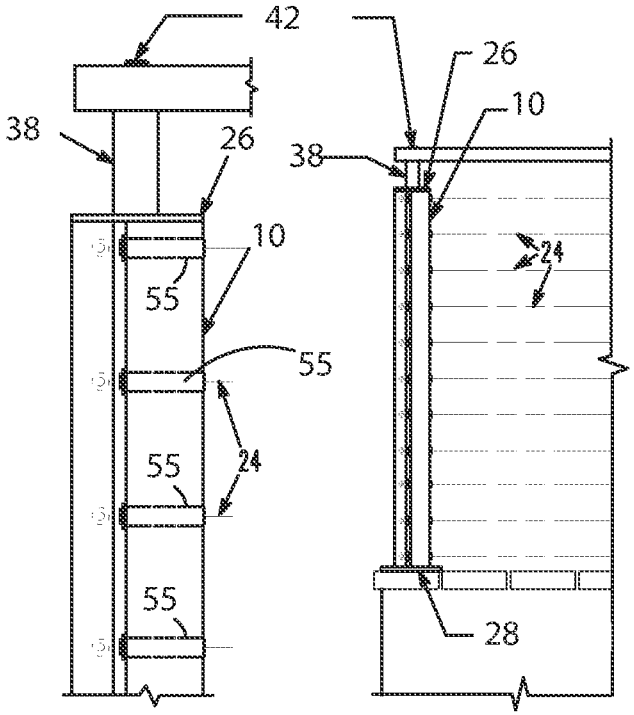
FIGS. 18A-18B illustrate a side view of a corner post, in accordance with embodiments described herein.

As previously described, the use of a corner post with receiver channels that are oriented transverse the longitudinal axis of a cavity that extends inside the corner post and is adapted to receive a tensioning cable therethrough permits the corner post to support two or more runs of cable railing in two or more directions with respect to the corner post. Reference is now made to FIGS. 18A-18B in which a side view of a corner post, such as that also shown in FIG. 2, is shown. In the enlarged view on the left, it can be seen that receivers 55 connected to cable rails 24 are accommodated in receiver channels embedded inside the corner post 10 as illustrated.

Figures 19A, 19B:
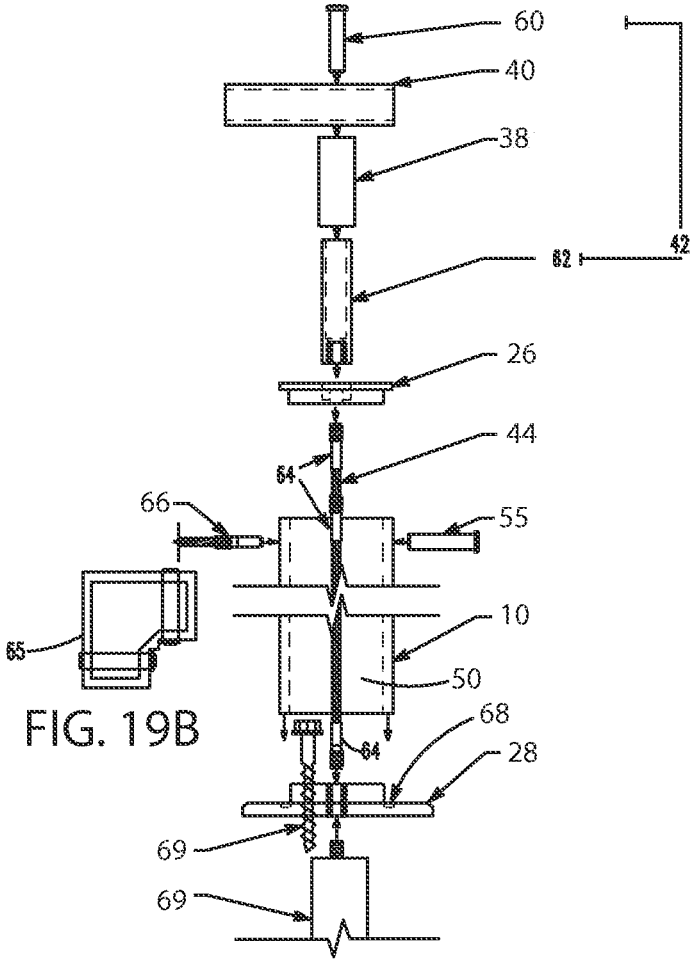
FIGS. 19A-19B illustrate an exploded view of a corner post assembly, in accordance with embodiments described herein.

FIGS. 19A-19B illustrates an exemplary corner post assembly, exploded view. In this exploded view, it can be seen that corner post 10 has a cavity 50 that accommodates the tensioning cable assembly 44, which is hidden by virtue of being in the cavity that runs along a longitudinal axis through the post. The tensioning receiver 42 is accomplished for a receiver 60 in communication with a post tensioner 62 as shown. Receiver studs 64 connect the cable assembly to the post tensioner 62, top plate 26, and base plate 28 as shown. In certain embodiments, a thin metal tube may be placed over the section of tensioning cable 44 between receiver studs 64 in order to combine the strength of the studs 64. The receiver 55 is received by a receiver channel of the corner post and is configured to mate with a swaged stud 66, for example. Base plate 28 is threaded to connect with the embedment as shown.

To assemble the corner post assembly shown, the base plate 28 is fastened or embedded into an embedment (embed), such as concrete. As indicated by reference number 69, a lag (such as a 5/16 inch) or equivalent for wood or simulated material decks can be used, or a screw as shown or a rod for embed. The tensioning cable assembly 44 is threaded into the base plate. The post is installed into the groove 68 in the base plate on which the post rests or shim is placed. The top cap/plate 26 is placed on the assembly. The post tensioner 62 is threaded onto the cable assembly and the post is tightened. The top bar is placed onto the top cap/plate 26 and the outside edges of the tensioner can be marked on the bottom of the top bar 40. A hole can be drilled in the bottom of the top bar 40 and a corresponding smaller hole is drilled into the top of the top bar 40. The standoff 38 is placed over the tensioner 62. The top bar is tightened over the cable using receiver 60, such as by using a hex wrench. The cable is tensioned to the tension needed to provide required stability and strength of the railing. For example, the cable may be tensioned to 400 ft. pounds.

A corner post may have a finished height of 36 inches for residential application or 42 inches for commercial application.

It can be seen from the exploded corner post of FIG. 19B that the entire corner post assembly is held in place with connection hardware that is hidden from view. The post configuration shows no exterior screws, bolts, or other fasteners, with everything needed to fasten the rail assembly to a structure hidden inside the post. The tensioning cable assembly holds the entire corner post assembly together with threaded fittings, and the tensioning hardware is hidden inside the post(s).

The corner post 10 may be of different shapes, and as indicated in reference number 65, and further illustrated in the top view of corner post 10 of FIGS. 20A-20D, may be configured to have receiver channels 56 at a first orientation and at a second orientation perpendicular to the first orientation, such that a 90 degree or other offset of one receiver channel from the other receiver channel in the same plane is achieved.

Figure 21A:
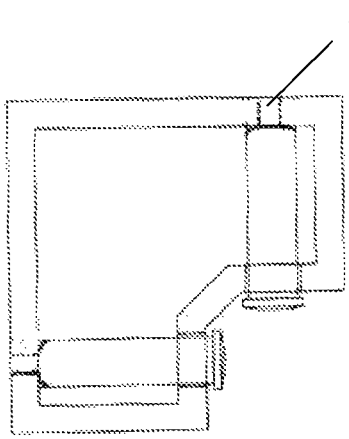
Figure 21B:
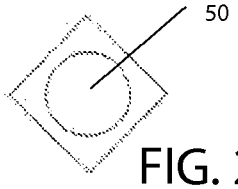

First and second receiver channels thus oriented may reside in the same horizontal plane, i.e. be co-planar, and thus are configured to receive receivers coupled to railing cables in substantially the same plane, i.e. the same horizontal plane. Thus, a first section of railing along one edge of a deck, for example, may enter the corner post in a first receiver channel having a first orientation at a certain height above the surface of a structure, and a second section of railing along another edge of the deck may exit a second receiver channel of the same corner post at a second orientation at the same height. The orientations of the receiver channels may be perpendicular to one another, such that the first and second sections of railing would also be perpendicular with respect to one another, i.e. 90 degrees. While the receiver channels may be substantially perpendicular, other angled arrangements may be employed. It can be seen that such a receiver channel arrangement of the corner post as shown in FIGS. 20A-20D permits this to occur. And, receipt of a receiver by a receiver channel occurs inside the corner post and thus presents a clean, hidden way of coupling cable railing to the post. It can be seen that the cavity 50 without the corner post 10 may be oriented as desired to present a corner post without corner extension 65, as in FIGS. 20A and 20B, or a corner post with corner extension 65', shown in FIG. 20C and FIG. 20D. It can be seen in the top view of the corner post without corner extension of FIGS. 21A-21B that adjustment of the receiver channel 56' permits the use of swageless fittings on the corner post if so desired.

Figure 22:
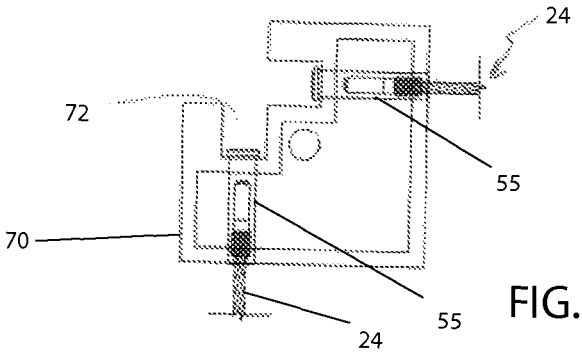
Figure 23:
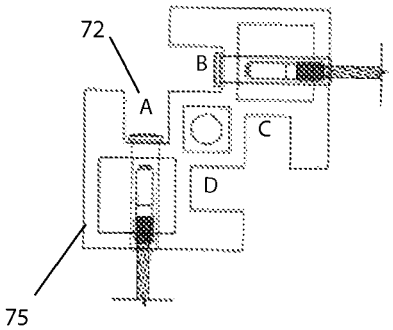

Reference to FIGS. 22 and 23 illustrate alternate embodiments of a corner post. In the top views of both drawings, receiver channels 72 are recessed within the post as shown. In FIG. 22 two receiver channels 72 of different orientations, in this case perpendicular orientations are shown, and permit railing (cable assembly 24) to be coupled to the corner post 70 at the same height on the corner post but at different orientations. FIG. 23 illustrates corner post 75, also with recessed receiver channels 72. There are four receiver channels shown, though three could also be used if desired. Not all receiver channels may reside in the same plane above the surface to which the corner post is attached, as the cable rails would interfere in the same plane. However, a pair of receiver channels, such as A and B or C and D, being perpendicular to one another, may co-exist in the same horizontal plane and the pairs themselves could be offset in the horizontal plane (i.e. height on the corner post) and even achieve a spiral effect of the railing on the corner post. Consider the following illustrious example. The receiver channels A and B of the first pair could be at a first height on the corner post, while receiver channels C and D of the second pair could be at a second height on the corner post that is different from the first height.

Figure 24:
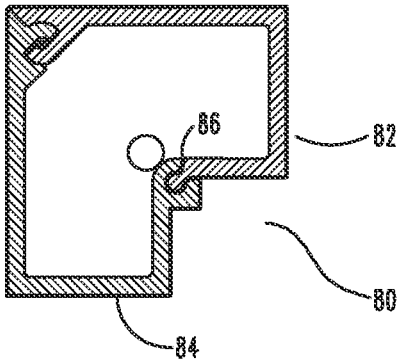
Figure 25:
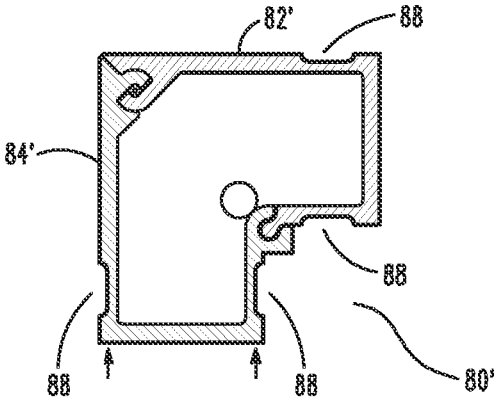
Figure 26:
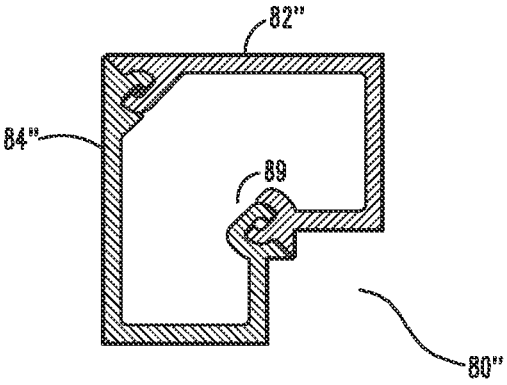

The corner post, or other types of posts, including intermediate and end or combination posts, for that matter, may be constructed of one piece of material, such as a single extruded piece, or they may be formed of multiple parts that are fastened together by pins, screws or the like, without departing from the spirit and scope of the various embodiments. As shown in FIG. 24, corner post 80 is formed of first and second parts 82 and 84, fastened together by a pin at one corner and having a friction fitting 86 at an opposite corner. The shape of corner post 80 approximates that of corner post 65' of FIG. 20, formed of one piece, and also has a corner extension. It is noted that corner post 65, also of FIG. 20, could likewise be formed of two or more pieces. In FIG. 25, corner post 80' has recessed portions 88 of first and second parts 82' and 84' to accommodate the receivers received by the receiver channels of the corner post. In FIG. 26, corner post 80" is formed of two pieces 82" and 84" with a differently configured friction fitting 89 as shown.

Extrusion of the corner post in two or more pieces that are then fastened together may be particularly advantageous when the corner post is formed of certain materials, such as bronze. Further, forming the corner post of two or more pieces in any material may greatly reduce the cost of manufacture.

Figures 27A, 27B:
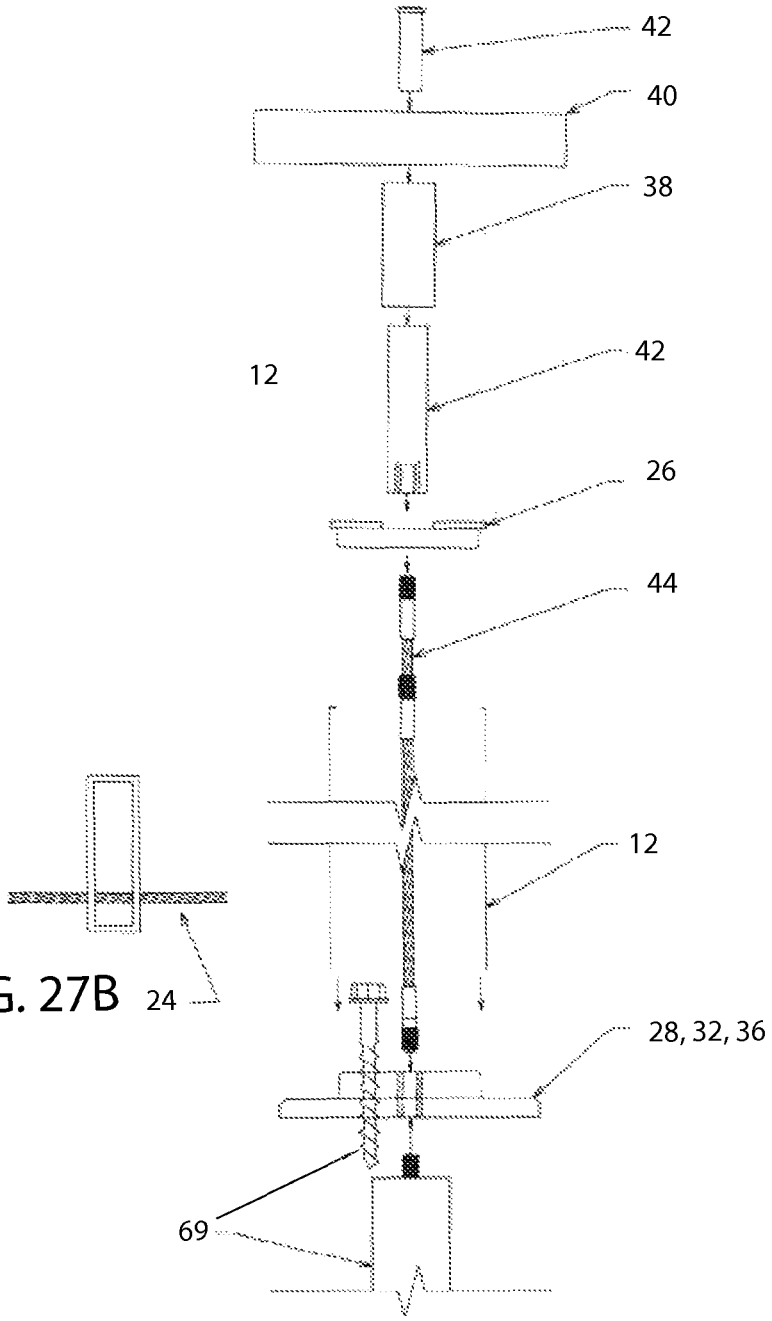
FIGS. 27A-27B illustrate an exploded view of an intermediate post assembly, in accordance with embodiments described herein.

In addition to the corner posts previously discussed, FIG. 27A illustrates an intermediate post assembly 12, exploded view, while FIG. 27B shows a cable loading detail, vertical along post 12. Intermediate post 12 has the receiver and post tensioner, illustrated as tensioning receiver 42 of FIG. 2, that allow the cable assembly and intermediate post to be tensioned to the supporting structure, whether it be a deck, flooring, etc. As indicated by reference number 69, a lag or equivalent for wood or simulated material decks can be used, or a screw as shown or a rod for embed. Bottom cap (base plate) 28, 32, 36 may be cast.

Figure 3A:
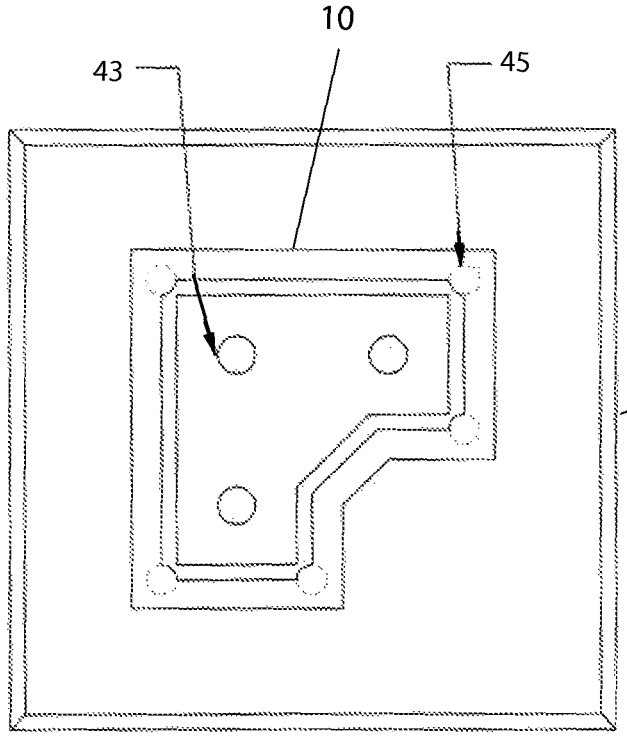
FIGS. 3A-3C illustrate a base plate in use with a corner post of FIG. 2, in accordance with embodiments described herein.
Figure 3C:
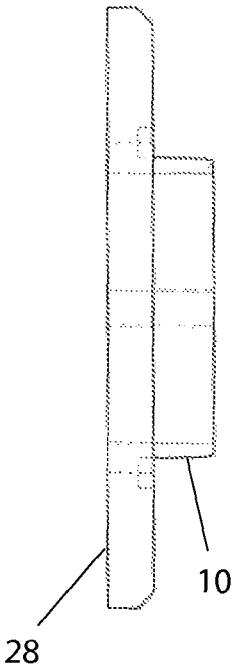
Figure 3B:
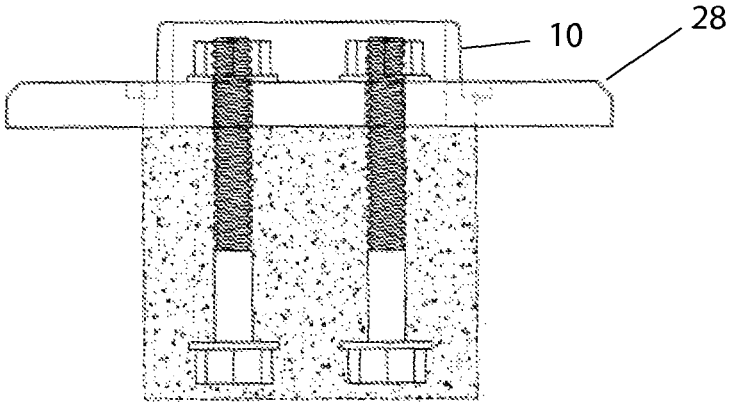
Figure 4A:
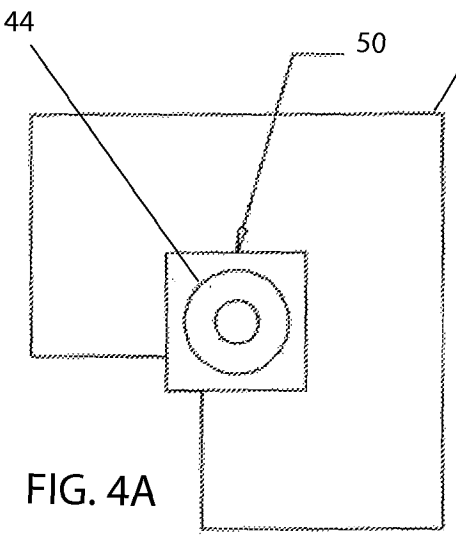
FIGS. 4A-4E illustrate a top plate in use with a corner post of FIG. 2, in accordance with embodiments described herein.
Figure 4B:
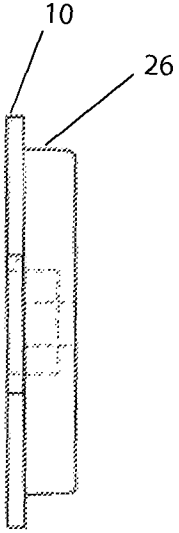
Figure 4C:
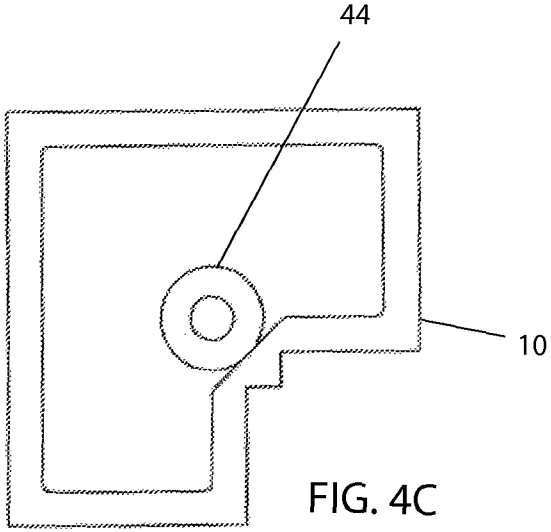
Figure 4D:
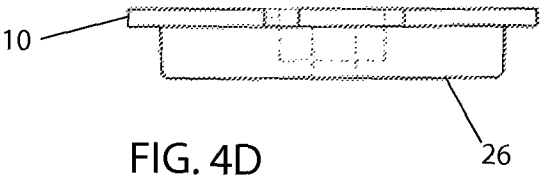
Figure 4E:
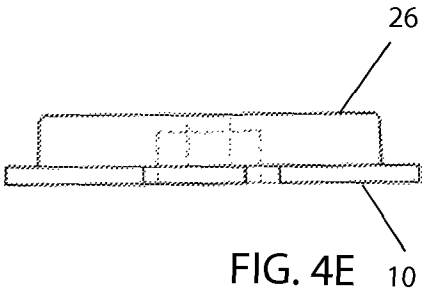

The intermediate post may be used to support cable railing every 42 inches or less to maintain cable spacing and to meet certain construction industry standards, such as IRC Code Standard 1×3×⅛ inch architectural aluminum. The intermediate post can be installed on wood, man-made deck materials or core drilled into concrete. An example aluminum embedment is illustrated in FIGS. 3B and 10B. Example dimensions of an intermediate post are 1×3×⅛ inch. An intermediate post may have a finished height of 36 inches for residential application or 42 inches for commercial application.

As may be understood by reference to the exploded view of FIG. 27A, a process of assembling the intermediate post would include the following: mount base plate 32; thread the cable assembly 44 onto the base plate; place the intermediate post 12 into a groove of the base plate; put the top cap, which may be cast aluminum, in place; thread the post tensioner onto the cable assembly and tighten post into place. Place the rail or top bar 40, which may have dimensions of 1×3 inches, for example onto the top cap and make the outside edges of tensioner on the bottom or top bar, drill hole in the bottom of the top bar and slightly smaller hole on the top of the top bar; place standoff 38 over the post tensioner (again, the standoff may be a 90 degree cut in the case of a placement of the railing on a horizontal surface or it may be angled 45 degrees to accommodate placement of the railing on stairs); and start receiver 42 on the cable and fasten top bar to the assembly. The receiver 42 may be tightened with a wrench, such as a 3/16 inch hex wrench. The cable is tensioned to the tension needed to provide required stability and strength of the railing. For example, the cable may be tensioned to 400 ft. pounds.

It can be seen from the exploded view of the intermediate post of FIG. 27A that the entire intermediate post assembly is held in place with connection hardware that is hidden from view. The post configuration shows no exterior screws, bolts, or other fasteners, with everything needed to fasten the rail assembly to a structure hidden inside the post. The tensioning cable assembly holds the entire intermediate post assembly together with threaded fittings, and the tensioning hardware is hidden inside the post(s).

Figure 28:
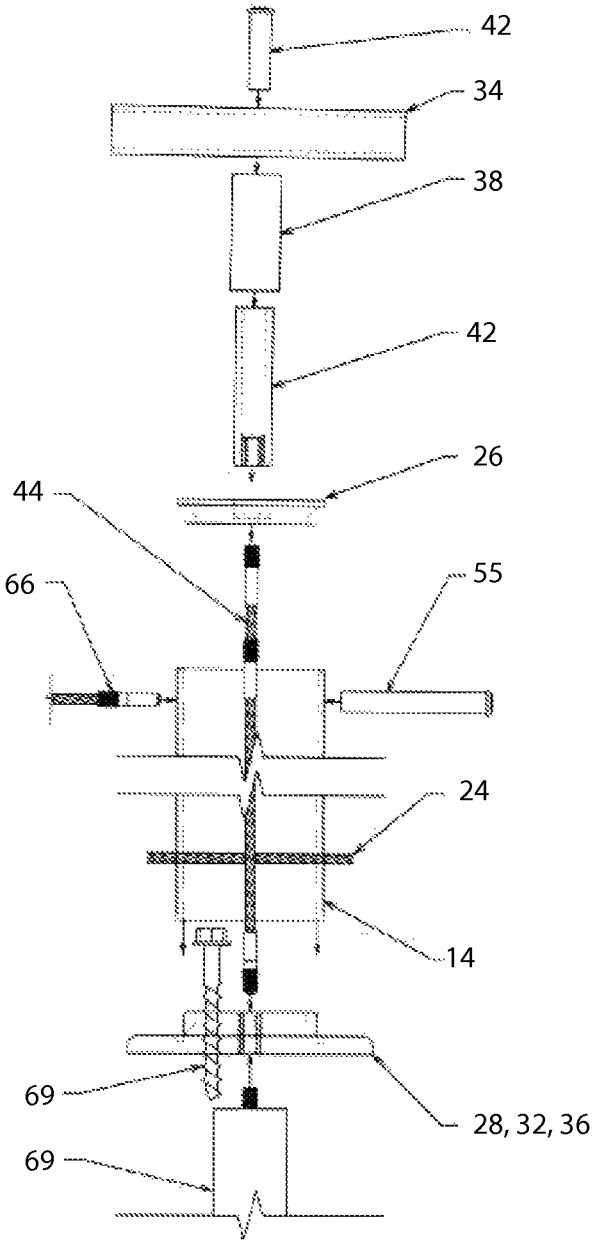
Figure 30:
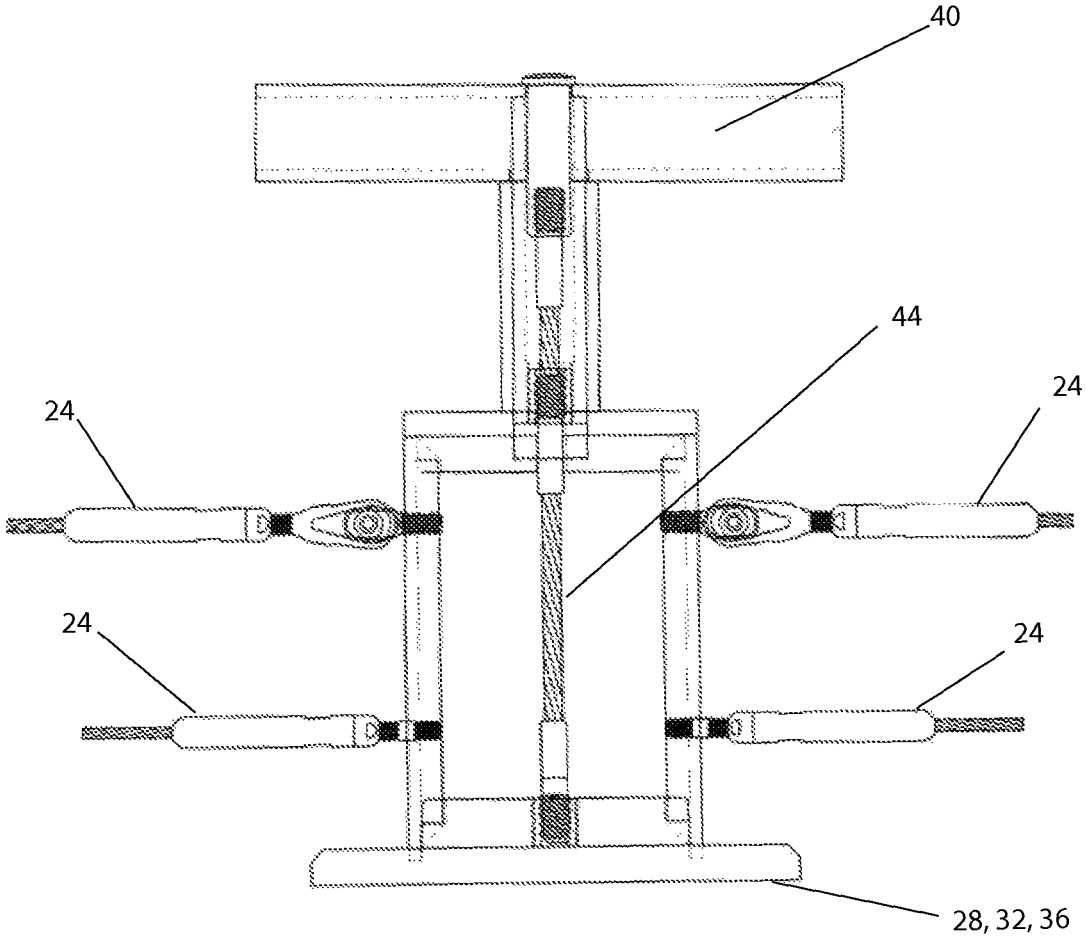
FIG. 30 illustrates a combination post configuration, in accordance with embodiments described herein.

Reference is now made to FIGS. 28, 29A-29B, and 30, in which illustration of the combination post 14 is provided. In FIG. 28, an exploded view of a combination post assembly is illustrated. When used as an intermediate post 14, a through cable 24 along the post is shown. Receiver 55 along the post and a swaged stud 66 is used when the post is an end post. A combination post may be used to offer structural support for railing every 7 feet or less, whereas an intermediate post may be used to provide support of the cable railings every 42 inches or less to maintain cable spacing and to meet code requirements. A combination post may have a finished height of 36 inches for residential application or 42 inches for commercial application. As indicated by reference number 69, a lag or equivalent for wood or simulated material decks can be used, or a screw as shown or a rod for embed. FIGS. 29A-29B illustrates a combination post and provides mounting options using threaded fittings for when the post is used as a corner post, intermediate post, or a "tee" post, as illustrated in the various configurations of the mounting bar shown in FIG. 29B. This embodiment illustrates use of a flat mounting bar 88. A combination post may come pre-drilled with 3 1/16 inch hole spacing and may utilize a pre-drilled and tapped flat mounting bar 88, (such as ¼ inch×1 inch) into which various hardware would screw; the holes may have 5/16×24 inch threads, for example. Flat bar 88 may be held in notches on the top plate 34 and base plate 36, as shown, along an inside edge of combination post 14, which allows the force of the fittings and the cable assembly 44 to pull against flat bar 88 instead of the wall of the post 14. Alternately, a friction drill bit could be used and permits a thinner wall post (such as ⅛ inch as opposed to ¼ inch, for example) to be used, thereby eliminating the need for the flat bar 88. Such a configuration would still have ¼ inch of usable threads, thereby eliminating the need for a more expensive material and component. This arrangement allows external hardware to be fastened to the combination post 14 or to be used when the post is up against a wall. As indicated by reference number 69, a lag (such as a 5/16 inch) or equivalent for wood or simulated material decks can be used, or a screw as shown or a rod for embed. Bottom cap (base plate) 28, 32, 36 may be cast. FIG. 30 illustrates an example configuration of a combination post. The cable assembly is tensioned to the tension needed to provide required stability and strength of the railing. For example, the cable may be tensioned to 400 ft. pounds.

It can be seen from the exploded view of the combination post of FIG. 28 that the combination post assembly is held in place with connection hardware that is hidden from view. The post configuration shows no exterior screws, bolts, or other fasteners, with everything needed to fasten the rail assembly to a structure hidden inside the post. The tensioning cable assembly holds the combination post assembly together with threaded fittings, and the tensioning hardware is hidden inside the post(s).

FIGS. 31A-31F illustrate a rail bracket 85 that may be used in the railing system described herein, with assorted mountings that may be employed. Included are wood posts in FIG. 31A, a masonry mount in FIG. 31C, a wood handrail as in FIG. 31E, and an exploded view post mount in FIG. 31F. A front view of bracket 85 is illustrated in FIG. 31D. In the exploded view post mount of FIG. 31F, it can be seen that bracket 85 in this embodiment is comprised of a bracket arm 86, a bracket stem 87 useful for an aluminum post, a saddle 88 comprised of a plug welded to a swivel as shown, and a button head screw 89. In the wood post of FIG. 31A a hanger bolt 71 may be used as shown. In the masonry mount example of FIG. 31C, an epoxy embodiment 73 may be used as shown.

Figure 32A:
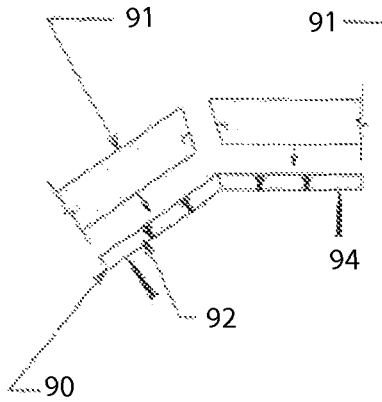
Figure 32B:
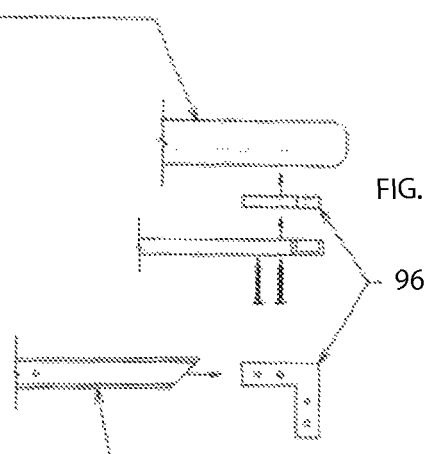
Figure 32C:
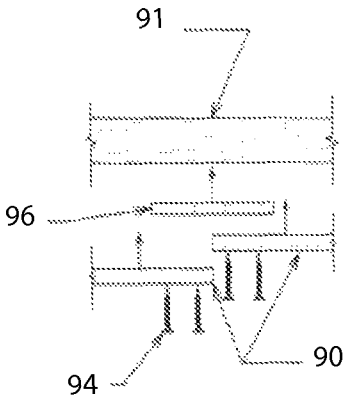
Figure 32D:
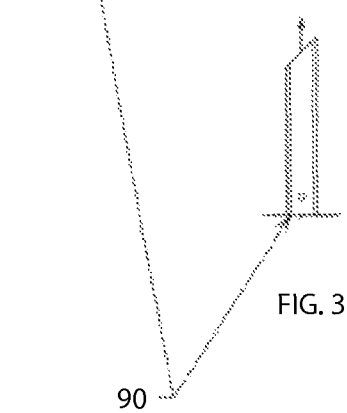
Figure 33:
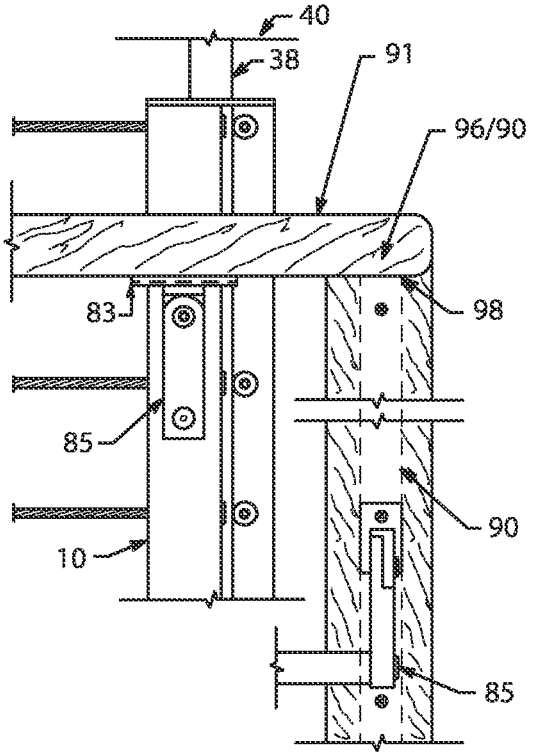
Figures 34A, 34B, 34C, 34D:
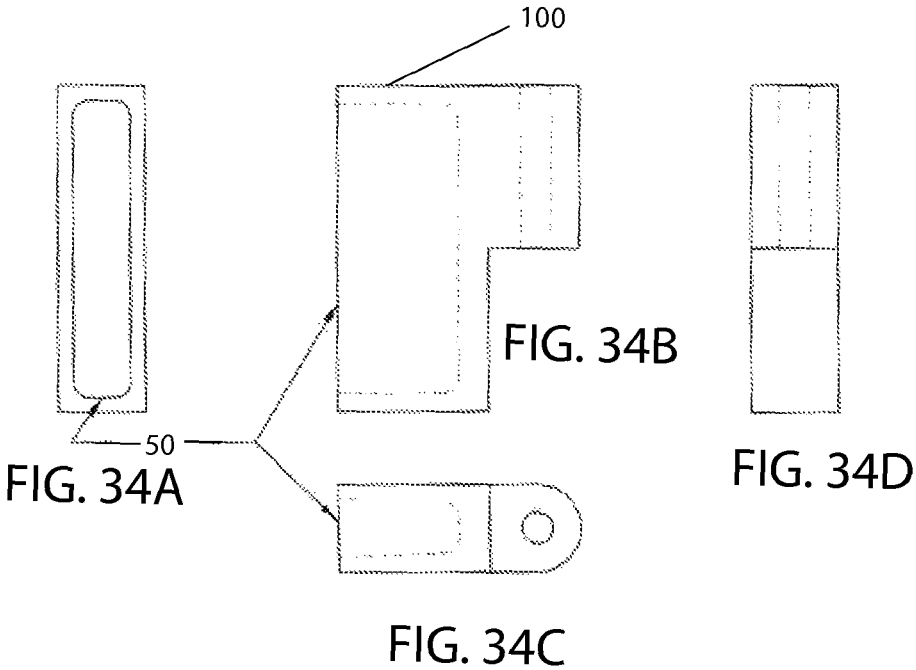

Further with regard to a wood railing or wood top configuration, FIGS. 32A-32D demonstrate various handrail 91 mounting options that may be employed, as does the wood handrail corner post assembly illustrated in FIG. 33. As illustrated there is an option for a channel 90, such as a 1×½×⅛ inch, a 1½×½×⅛ inch, or a 1¼×½×⅛ inch aluminum, stainless, brass, bronze, or wood channel, that connects to the top of the standoff, thereby allowing a contractor to install wood or fasten their own wood to the top of the railing system. The channel, for example, may have 3/18 inch holes 12 inch on center. A strap hinge 92 and one or more fasteners 94 may be used to attach the channel to the handrail 40 as shown. One or more splice plates 96 may be used as illustrated in FIGS. 32B and 32C for the channel when mounting on wood. As shown in FIG. 32D. a 90 degree splice plate can be used in connection with two channels 90 as shown. The contractor could additional fashion the wood top as desired so that the metal strip of the channel is not seen. Further, in FIG. 33, a swivel assembly 83 may be fastened to the channel 90 and handrail 91 as shown. Also, a hidden 90 degree splice plate and channel combination 96/90 may be used, as well as a hidden turndown hardware as indicated by reference number 98. At the bottom of the drawing, a handrail bracket 85 may be used on the stair post and is held by cable.

Referring now to FIGS. 34A-34D and FIGS. 35A-D, hinges are used to attach the hand rail or top rail 40 in the railing system. In FIGS. 34A-34D, a vertical hinge 100 attaches each piece of handrail in the "Z" axis and is able to accommodate any pitch range of either existing or new construction stairways or ramps. This hinge will also connect sections of the top bar whenever the angle of the top bar changes. Accordingly, the vertical hinge may be inserted into the top bar on each side of the miter joint with a couple of stainless self-tapping screws, for example, which will screw up into a hollow chamber into the vertical hinge. The vertical hinge can be used to hold the handrail in place at any angle or on any length top bar that needs to be extended.

Exemplary cable railing systems in accordance with the disclosure include the following embodiments:

1. A cable railing system for securing a cable railing flush to a surface of a structure, the system comprising:

a first post having a cavity extending along a longitudinal axis extending the length of the first post from the top of the first post to the bottom of the first post and configured to receive a first tensioning cable there-through and a first plurality of receiver channels oriented transverse the longitudinal axis along one or more sides of the first post, each receiver channel of the first plurality of receiver channels configured to receive a receiver;

a first base plate coupled to the bottom of the first post and the first tensioning cable; and a first top plate coupled to the top of the first post and the first tensioning cable;

a first tensioner element coupled to the first top plate, wherein activation of the first tensioner element engages the first tensioning cable and tensions the first top plate, the first post, and the first base plate to a surface to which the first base plate is coupled;

a second post having a cavity extending along a longitudinal axis extending the length of the second post from the top of the second post to the bottom of the second post and configured to receive a second tensioning cable there-through and a second plurality of receiver channels oriented transverse the longitudinal axis along one or more sides of the second post, each receiver channel of the second plurality of receiver channels configured to receive a receiver;

a second base plate coupled to the bottom of the second post and the second tensioning cable; and a second top plate coupled to the top of the second post and the second tensioning cable;

a second tensioner element coupled to the second top plate, wherein activation of the second tensioner element engages the second tensioning cable and tensions the second top plate, the second post, and the second base plate to a surface to which the second base plate is coupled; and a plurality of cable rails operable to be coupled to receivers received by the first plurality of receiver channels and to receivers received by the second plurality of receiver channels.

2. The cable railing system of embodiment 1, further comprising:

a third post having a cavity extending along a longitudinal axis extending the length of the third post from the top of the third post to the bottom of the third post and configured to receive a third tensioning cable there-through and a third plurality of receiver channels oriented transverse the longitudinal axis along one or more sides of the third post, each receiver channel of the third plurality of receiver channels configured to receive a receiver;

a third base plate coupled to the bottom of the third post and the third tensioning cable; and a third top plate coupled to the top of the third post and the third tensioning cable; and a third tensioner element coupled to the third top plate, wherein activation of the third tensioner element engages the third tensioning cable and tensions the third top plate, the third post, and the third base plate to a surface to which the third base plate is coupled.

3. The cable railing system of embodiment 2, wherein a first number of cable rails of the plurality of cable rails is coupled to receivers received by the first plurality of receiver channels of the first post and to receivers received by the second plurality of receiver channels of the second post and wherein a second number of cable rails of the plurality of cable rails is coupled to receivers received by the second plurality of receiver channels of the second post and to receivers received by the third plurality of receiver channels of the third post.

4. The cable railing system of embodiment 3, wherein the first number of cable rails is coupled to receivers received by a first group of receiver channels of the second plurality of receiver channels of the second post, and the second number of cable rails is coupled to receivers received by a second group of receiver channels of the second plurality of receiver channels of the second post, and wherein the first group of receiver channels of the second plurality of receiver channels of the second post are recessed into the body of the second post at a first orientation along a first side of the second post and the second group of receiver channels of the second plurality of receiver channels of the second post are recessed into the body of the second post at a second orientation along a second side of the second post.

5. The cable railing system of embodiment 4, wherein the second post is a corner post and wherein the second orientation is perpendicular that of the first orientation.

6. The cable railing system of embodiment 4, wherein the first and second groups of receiver channels of the second plurality of receiver channels of the second post are coplanar.

7. The cable railing system of embodiment 2, wherein the first, second, and third plurality of receiver channels are recessed within the first, second and third post, respectively, and tensioning receivers received by the first, second and third plurality of receiver channels and the plurality of cable rails secured and tensioned therein, the plurality of first, second and third receiver channels are not viewable.

The horizontal hinged connector 110 of FIGS. 35A-35D attaches each piece or section of handrail in the "X" axis regardless of its angle. The horizontal hinge may be inserted into the top bar on each side of the miter joint with a couple of stainless self-tapping screws, for example, which will screw up into a hollow chamber into the horizontal hinge. The horizontal hinge 110 may be countersunk for a screw(s) at 112. The horizontal hinge can be used to hold the handrail in place at any angle or on any length top bar that needs to be extended. Further, the horizontal hinge has a hole, such as a 1 inch cavity, in the center of both pieces to allow it to fit over the tensioner 42 on the inside of the top bar.

The implementations of the present disclosure described above are intended to be examples only. Those of skill in the art can effect alterations, modifications and variations to the particular example embodiments herein without departing from the intended scope of the present disclosure. Moreover, selected features from one or more of the above-described example embodiments can be combined to create alternative example embodiments not explicitly described herein.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A post assembly configured to enable a post to be secured to a surface, the post assembly comprising:

a post having:

a cavity extending along a longitudinal axis of the post from the top of the post to the bottom of the post;

a top plate having a cavity therein and configured to contact the top of the post;

a post tensioner configured to contact the top plate;

a receiver; and a tensioning cable configured to pass through the cavity of the post, the tensioning cable comprising:

a first threaded section operable to pass through the top plate and engage the post tensioner to secure the post to the surface by providing tension between the top plate and the surface; and a second threaded section operable to pass through a fitting, located between the receiver and the top of the post, and engage the receiver to secure the fitting to the post by providing tension between the receiver and the top of the post.

2. The post assembly of claim 1, wherein the cavity extends through the post at substantially a center region of the post.

3. The post assembly of claim 1, wherein the cable assembly is at least one of a cable, a cable rail, a swaged cable assembly, and a swageless cable assembly.

4. The post assembly of claim 1, further comprising a plurality of receiver channels recessed within the post and a plurality of tensioning receivers, wherein when the plurality of tensioning receivers are received by the plurality of receiver channels and a plurality of cable rails secured and tensioned therein, the plurality of receiver channels are not viewable.

5. The post assembly of claim 4, wherein a first receiver channel of the plurality of receiver channels is recessed into the body of the post at a first orientation and a second receiver channel of the plurality of receiver channels is recessed into the body of the post at a second orientation perpendicular that of the first orientation.

6. The post assembly of claim 5, wherein the first and second receiver channels are coplanar.

7. The post assembly of claim 4, wherein a first receiver channel pair of the plurality of receiver channels comprises a first receiver channel recessed into the body of the post at a first orientation and a second receiver channel of the plurality of receiver channels is recessed into the body of the post at a second orientation perpendicular that of the first orientation and a second receiver channel pair of the plurality of receiver channels comprises a third receiver channel recessed into the body of the post at the first orientation and a fourth receiver channel of the plurality of receiver channels is recessed into the body of the post at the second orientation perpendicular that of the first orientation.

8. The post assembly of claim 7, wherein the first and second receiver channels of the first receiver channel pair are coplanar and wherein the third and fourth receiver channels of the second receiver channel pair are coplanar.

9. The post assembly of claim 4, further comprising a plurality of threaded fittings operable to couple a top plate of the post and a bottom plate of the post to a surface on which the bottom plate is coupled upon activation of the tensioning cable.

10. The post assembly of claim 1, where the tensioning cable further comprises:

a first receiver stud;

a second receiver stud coupled to the first receiver stud via the first length of tensioning cable; and a third receiver stud coupled to the second receiver stud via the second length of tensioning cable;

where the tensioning cable is configured to pass through the cavity of the post, such that the first receiver stud extends from the bottom of the post and the second and third receiver studs extend from the top of the post and pass through the cavity of the top plate;

where the post assembly further comprises:

a post tensioner element configured to engage the second receiver stud and the top plate at a first end of the post tensioner, the post tensioner having a cavity therein to allow the third receiver stud to pass through the post tensioner and extend from a second end of the post tensioner;

where, when the first receiver stud is secured to the surface, activation of the tensioner element engages the second receiver stud and tensions the first length of tensioning cable such that the post is held between the top plate and the surface, and where the third receiver stud is configured engage the receiver and enable the fitting to be secured to the post assembly by tensioning the second length of tensioning cable.

11. A cable railing system for securing a cable railing flush to a surface of a structure, comprising:

a first tensioning cable;

a first post having a cavity extending along a longitudinal axis extending the length of the first post from the top of the first post to the bottom of the first post and configured to receive the first tensioning cable therethrough and a first plurality of receiver channels oriented transverse the longitudinal axis along one or more sides of the first post, each receiver channel of the first plurality of receiver channels configured to receive a receiver;

a first base plate coupled to the bottom of the first post and the first tensioning cable; and a first top plate coupled to the top of the first post and the first tensioning cable;

a first tensioner element coupled to the first top plate, wherein activation of the first tensioner element engages the first tensioning cable and tensions the first top plate, the first post, and the first base plate to a surface to which the first base plate is coupled;

a second tensioning cable;

a second post having a cavity extending along a longitudinal axis extending the length of the second post from the top of the second post to the bottom of the second post and configured to receive the second tensioning cable therethrough and a second plurality of receiver channels oriented transverse the longitudinal axis along one or more sides of the second post, each receiver channel of the second plurality of receiver channels configured to receive a receiver;

a second base plate coupled to the bottom of the second post and the second tensioning cable; and a second top plate coupled to the top of the second post and the second tensioning cable;

a second tensioner element coupled to the second top plate, wherein activation of the second tensioner element engages the second tensioning cable and tensions the second top plate, the second post, and the second base plate to a surface to which the second base plate is coupled;

a first plurality of threaded receivers configured to be located in the first plurality of receiver channels;

a second plurality of threaded receivers configured to be located in the second plurality of receiver channels; and a plurality of cable rails operable to be coupled to the first and second pluralities of threaded receivers, wherein the first and second top plates comprise a top rail that extends from the first post to the second post, the top rail being positioned on top of the first and second posts.

12. The cable railing system of claim 11, wherein the first tensioning cable is coupled to the first base plate and the first top plate by a first plurality of threaded fittings internal to the first post and activation of the first tensioner element activates the first plurality of threaded fittings to tension the first top plate, the first post and the first base plate to the surface to which the first base plate is coupled, and wherein the second tensioning cable is coupled to the second base plate and the second top plate by a second plurality of threaded fittings internal to the second post and activation of the second tensioner element activates the second plurality of threaded fittings to tension the second top plate, the second post and the second base plate to the surface to which the second base plate is coupled.

13. The cable railing system of claim 11, wherein each cable rail of the plurality of cable rails are one or more of a cable, a cable assembly, swaged cable assembly, and a swageless cable assembly.

14. The cable railing system of claim 11, wherein one or more cable rails of the plurality of cable rails may be coupled to one or more corresponding cable assemblies that are placed into one or more receivers that are received by the first plurality of receiver channels or the second plurality of receiver channels.

15. The cable railing system of claim 11, wherein the structure is a horizontally oriented deck and the cable railing is surface mounted to a top surface of the deck.

16. The cable railing system of claim 11, wherein the structure is a vertically orientated deck and the cable railing is a surface mounted to a side surface of the deck.

17. The cable railing system of claim 11, wherein the first and second plurality of receiver channels are recessed within the first and second posts, respectively, and tensioning receivers received by the first and second plurality of receiver channels and the plurality of cable rails secured and tensioned therein, the plurality of first and second receiver channels are not viewable.

18. The cable railing system of claim 11, further comprising:

a third tensioning cable;

a third post having a cavity extending along a longitudinal axis extending the length of the third post from the top of the third post to the bottom of the third post and configured to receive the third tensioning cable therethrough and a third plurality of receiver channels oriented transverse the longitudinal axis along one or more sides of the third post, each receiver channel of the third plurality of receiver channels configured to receive a receiver;

a third base plate coupled to the bottom of the third post and the third tensioning cable; and a third top plate coupled to the top of the third post and the third tensioning cable; and a third tensioner element coupled to the third top plate, wherein activation of the third tensioner element engages the third tensioning cable and tensions the third top plate, the third post, and the third base plate to a surface to which the third base plate is coupled.

* * * * *